US007469685B2

(12) United States Patent
Osanai

(10) Patent No.: US 7,469,685 B2
(45) Date of Patent: Dec. 30, 2008

(54) CONTROL APPARATUS FOR INTERNAL COMBUSTION ENGINE

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 223 days.

(21) Appl. No.: 11/033,404

(22) Filed: Jan. 12, 2005

(65) Prior Publication Data

US 2005/0154520 A1 Jul. 14, 2005

(30) Foreign Application Priority Data

Jan. 14, 2004 (JP) ..... 2004-007184

(51) Int. Cl.
*F02M 33/02* (2006.01)
*F02D 41/00* (2006.01)

(52) U.S. Cl. ..... 123/520; 123/672; 123/679; 123/681; 123/685; 701/103

(58) Field of Classification Search ..... 123/357, 123/520, 703, 672, 679, 681, 685; 701/103
See application file for complete search history.

(56) References Cited

U.S. PATENT DOCUMENTS

| | | | | |
|---|---|---|---|---|
| 4,539,958 | A * | 9/1985 | Ito et al. | 123/693 |
| 5,680,849 | A * | 10/1997 | Morikawa et al. | 123/520 |
| 6,354,277 | B1 * | 3/2002 | Kato | 123/492 |

FOREIGN PATENT DOCUMENTS

| | | |
|---|---|---|
| JP | A-62-168957 | 7/1987 |
| JP | A-05-321738 | 12/1993 |
| JP | A-06-026386 | 2/1994 |
| JP | A-06-229287 | 8/1994 |
| JP | A-06-323177 | 11/1994 |
| JP | A-07-233750 | 9/1995 |
| JP | A-10-018883 | 1/1998 |
| JP | A-2001-082264 | 3/2001 |
| JP | A-2001-140707 | 5/2001 |
| JP | A-2003-003886 | 1/2003 |
| JP | A-2003-003891 | 1/2003 |

* cited by examiner

*Primary Examiner*—Stephen K. Cronin
*Assistant Examiner*—J. Page Hufty
(74) *Attorney, Agent, or Firm*—Oliff & Berridge, PLC

(57) ABSTRACT

The control apparatus for the internal combustion engine increases a fuel injection amount under predetermined conditions, such as after the start of the internal combustion engine, at cold time, at acceleration requiring time, at gear shifting time from a neutral to a D-range, for example. When the fuel injection amount is increased during execution of air/fuel ratio feedback control, the feedback control follows the increase amount, and executes correction corresponding to the increase amount. Then, at the point of time when the correction corresponding to the increase amount is completed, the increase of the fuel injection amount is stopped quickly. Thereby, the increase of the fuel injection amount is not continued unnecessarily, and therefore useless consumption of the fuel can be suppressed. Also, it becomes possible to start other controls early by finishing increase quickly. For example, when the canister purge is executed during the increase of the fuel injection amount, it is difficult to distinguish an evaporated fuel amount by purge and an increase amount by the fuel increase, and learning precision of a vapor concentration is lowered. Therefore, purge is not performed during the increase of the fuel injection amount, and the purge control is performed after the fuel increase is stopped quickly, whereby it becomes possible to start purge control early.

11 Claims, 21 Drawing Sheets

CONTROL APPARATUS FOR INTERNAL COMBUSTION ENGINE

BACKGROUND OF THE INVENTION

1. Field of the Invention

The present invention relates to increase control and increase stop control of a fuel injection amount of an internal combustion engine.

2. Description of the Related Art

In an internal combustion engine, so-called air/fuel ratio feedback control is carried out to keep the air/fuel ratio at a target air/fuel ratio. More specifically, an oxygen concentration in exhaust gas is detected by an oxygen concentration sensor provided in an exhaust system of the internal combustion engine, and the air/fuel ratio is calculated based on the detected oxygen ratio and the fuel injection amount. A feedback correction amount is determined to eliminate a deviation of the calculated air/fuel ratio and the target air/fuel ratio, thereby performing feedback control of the fuel injection amount.

In an automobile, a canister which adsorbs evaporated fuel in a fuel tank is provided, and canister purge (hereinafter, simply called "purge") for desorbing the fuel adsorbed in the canister from an adsorbent and supplying the fuel to an intake system of the engine is carried out. On the occasion of the canister purge, a vapor concentration in the purge gas is learned, and based on the result, the fuel injection amount is corrected.

When the temperature of cooling water is low at the starting time of an engine or the like, the fuel injection amount is increased. However, when the fuel injection amount is increased, it is difficult to determine whether the change in the air/fuel ratio calculated by utilizing the oxygen concentration sensor is caused by the increase of the fuel injection amount, or by purge, and therefore, learning precision of the vapor concentration is reduced. On the other hand, when the canister purge is not performed while the fuel injection amount is being increased at cold time after the start of the engine or the like, there arises the problem that the purge cannot be executed early at the cold time of the engine.

A method of prohibiting execution of purge while the increase of fuel is performed at the cold time after the start of the engine is proposed in Japanese Patent Application Laid-open under No. 6-323177. A method of starting purge when the cooling water temperature is a predetermined value or higher is proposed in Japanese Patent Application Laid-open under NO. 2001-82264. Japanese Patent Applications Laid-open under Nos. 10-18883 and 6-26386 concerns the control of the fuel increase amount at the engine cold time and the purge starting time after the start of the engine.

SUMMARY OF THE INVENTION

The present invention is made in view of the above respects, and its object is to provide a control apparatus for an internal combustion engine capable of preventing useless consumption of fuel by efficiently performing increase of the amount of fuel and by executing other controls such as purge control early.

According to one aspect of the present invention, there is provided a control apparatus for an internal combustion engine including an increasing unit which increases a fuel injection amount under a predetermined condition, an air/fuel ratio feedback control unit which controls the fuel injection amount based on an output of an oxygen concentration sensor, and a control unit which decreases an increase amount of the fuel injection amount by the increasing unit when the air/fuel ratio feedback control unit corrects the increase amount of the fuel injection amount by the increasing unit.

The above-described control apparatus increases the fuel injection amount under the predetermined conditions, for example, after start of the internal combustion engine, at cold time, at acceleration requiring time, at gear shift time to a D-range from a neutral position and the like. When the fuel injection amount is increased during execution of the air/fuel ratio feedback control, the feedback control follows the increase amount and executes correction corresponding to the increase amount. Then, at the point of time when the correction corresponding to the increase amount is completed, the feedback control decreases the increase amount of the fuel injection amount quickly. As a result, the increase of the fuel injection amount is not continued unnecessarily, and useless consumption of the fuel can be suppressed. By finishing the fuel increase quickly, it becomes possible to start the other controls quickly. It should be noted that "decreasing the increase amount of the fuel injection amount" includes the case where the fuel increase is completely stopped, and the case where the fuel increase amount is decreased to the range in which adverse effect is not exerted on the other controls such as vapor concentration learning operation in the purge control, for example.

In one mode, the control apparatus for an internal combustion engine may further include a purge control unit which executes purge of a canister immediately after the control unit decreases the increase amount of the fuel injection amount. When the canister purge is executed during the increase of the fuel injection amount, it becomes difficult to distinguish an evaporated fuel amount by purge and the increase amount by the fuel increase, and learning precision of the vapor concentration is lowered. Therefore, during the increase of the fuel injection amount, the purge is not performed, and the purge control is executed after the increase amount is decreased quickly.

In another mode of the control apparatus for an internal combustion engine, the control unit may perform determination of whether the increase amount of the fuel injection amount by the increasing unit is corrected or not after a predetermined time elapses from a start of feedback control by the air/fuel ratio feedback control unit. The feedback control easily becomes unstable immediately after start of the feedback control by the air/fuel ratio feedback control unit, and therefore erroneous determination and the like can be prevented by performing determination after the predetermined time elapses.

In still another mode of the control apparatus for an internal combustion engine, the control unit does not perform the determination of whether the increase amount of the fuel injection amount by the increasing unit is corrected or not during deceleration of the internal combustion engine. Since the negative pressure in the intake passage increases during decelerating operation of the vehicle, the fuel adhering to the wall surface or the like possibly enters the combustion chamber, and makes the control of the air/fuel ratio unstable. Therefore, it is preferable not to perform determination during decelerating operation.

In still another mode of the control apparatus for an internal combustion engine, the control unit may perform the determination of whether the increase amount of the fuel injection amount by the increasing unit is corrected or not when load variation of the internal combustion engine is equal to or smaller than a predetermined amount. When the load variation of the engine is large, the control of the air/fuel ratio possibly becomes unstable, and therefore determination is not performed when the load variation is large.

In a preferred example, the control unit may determine that the increase amount of the fuel injection amount is corrected when a feedback correction amount by the air/fuel ratio feedback control unit becomes a correction amount corresponding to the increase amount of the fuel injection amount. In this case, the determination of whether the increase amount of fuel injection amount is corrected or not can be easily executed by comparing the increase amount and the feedback correction amount. In this case, the control unit may determine that the increase amount of the fuel injection amount is corrected when an average value of the feedback correction amounts becomes the correction amount corresponding to the increase amount of the fuel injection amount. By taking the average value, influence of temporary cause of error can be excluded.

In still another preferred example, the control unit can determine that the increase amount of the fuel injection amount is corrected when a number of skips of a feedback correction amount by the air/fuel ratio feedback control unit becomes equal to or larger than a predetermined number. In this case, by monitoring the feedback correction amount, determination of whether the increase amount of the fuel injection amount is corrected or not can be easily executed.

According to still another mode, the control apparatus for an internal combustion engine may further include a fuel cut unit which executes fuel cut when a predetermined fuel cut condition is satisfied. The increasing unit may increase the fuel injection amount after execution of the fuel cut, and after the fuel injection amount is increased by the increasing unit, the control unit may decreases the increase amount of the fuel injection amount. After execution of the fuel cut, the fuel adhering to the wall surface of the intake passage and the like is consumed, and therefore it is preferable to increase the fuel injection amount, like the time of start of the engine and the like.

In still another mode of the control apparatus for an internal combustion engine, the control unit may decrease the increase amount of the fuel injection amount by the increasing unit, and at the same time, increase a feedback correction amount by the air/fuel ratio feedback control unit by the increase amount of the fuel injection amount. At the time of decreasing the increase amount of the fuel injection amount, the fuel injection amount abruptly changes, and therefore there is a possibility that the air/fuel ratio control becomes unstable, and vibration and shock occur to the vehicle. Therefore, the above-mentioned disadvantages can be prevented by decreasing the increase amount and correcting the feedback correction amount corresponding to that decrease to set the correction amount to zero.

In still another mode of the control apparatus for an internal combustion engine, the control unit may decrease the increase amount of the fuel injection amount by the increasing unit at a predetermined rate, and increase a feedback correction amount by the air/fuel ratio feedback control unit at a rate corresponding to the predetermined rate by the increase amount of the fuel injection amount. Since the fuel injection amount abruptly changes when the increase amount of the fuel injection amount is decreased, there is a possibility that the air/fuel ratio control becomes unstable, and vibration and shock occur to the vehicle. Therefore, the increase amount is gradually decreased to eventually decrease the increase amount, and the feedback correction amount is gradually corrected correspondingly to change the correction amount to the correction amount after the increase amount is decreased, whereby the above-described disadvantage can be prevented. In this case, it is preferable to set the predetermined rate to be smaller than the integration constant of the air/fuel ratio feedback control unit. Thus, by decreasing the fuel injection amount, the feedback correction amount is automatically corrected to follow the change of the fuel injection amount.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

Hereinafter, the best mode of carrying out the present invention will be explained with reference to the drawings.

[Construction of Control Apparatus]

Figure 1:
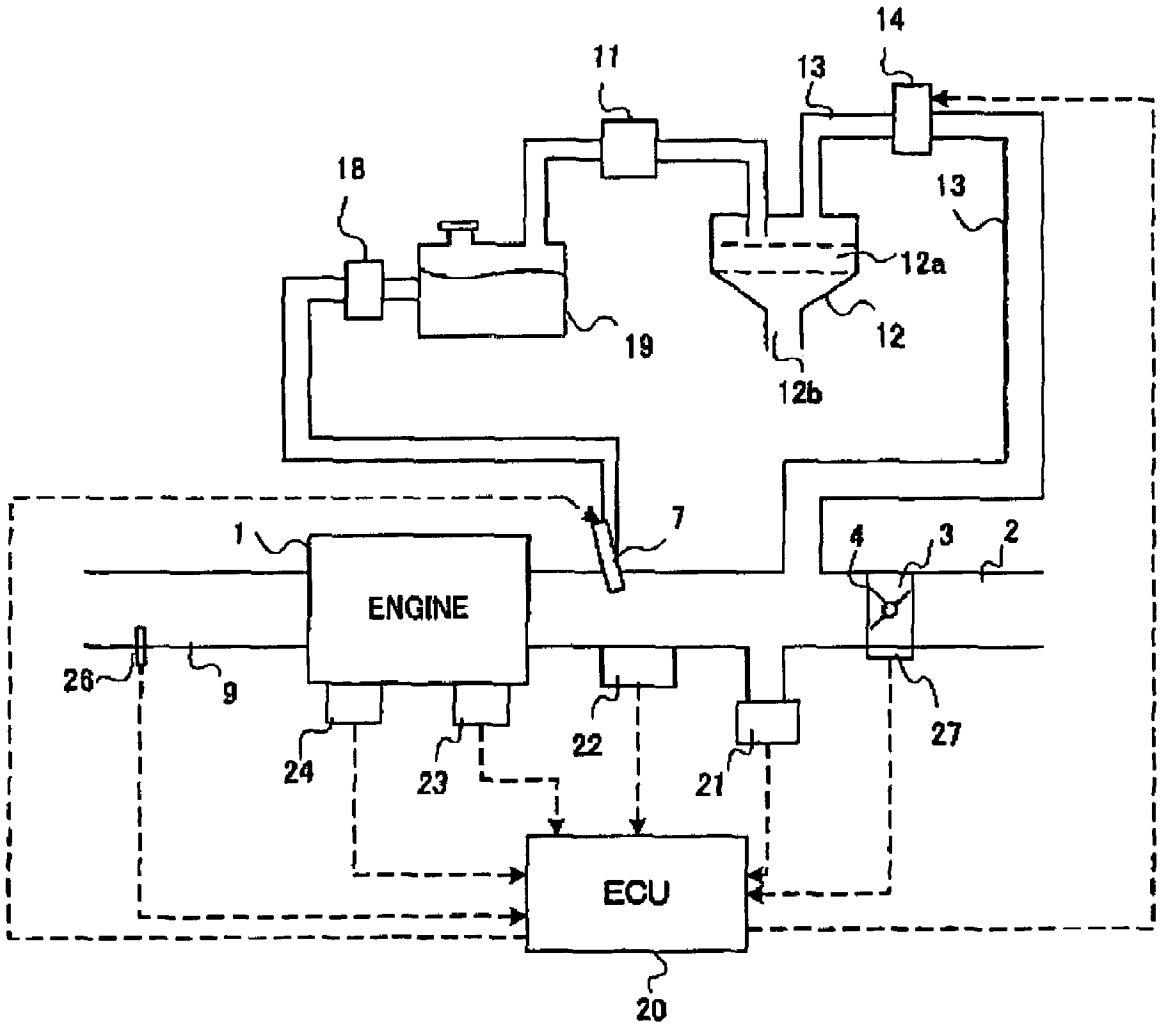
FIG. 1 is a block diagram showing a schematic construction of a control apparatus of an internal combustion engine according to an embodiment of the present invention.

First, a schematic construction of a control apparatus for an internal combustion engine according to the present invention will be explained. FIG. 1 shows a schematic construction of the control apparatus for an internal combustion engine. As shown in FIG. 1, outputs signal from various kinds of sensors around an engine 1 are supplied to an ECU 20, and a control signal is inputted to each component from the ECU 20.

More specifically, an intake pipe 2 of the engine 1 is provided with a throttle body 3. A throttle valve 4 is provided inside the throttle body 3, and an opening degree of the throttle valve 4 is detected by a throttle opening degree sensor 27 and supplied to the ECU 20. The intake pipe 2 is provided with a pressure sensor 21 for used inside the intake pipe at a downstream side from the throttle valve 4, and the pressure inside the intake pipe, which is its output, is supplied to the ECU 20. An intake air temperature sensor 22 is provided downstream from the pressure sensor 21, and the intake air temperature sensor 22 detects the temperature of the intake air inside the intake pipe 2 and supplies a corresponding electrical signal to the ECU 20.

A fuel injection valve 7 is provided for each cylinder, slightly upstream from an intake valve not shown of the engine 1, between the engine 1 and the throttle valve 4. The fuel injection valve 7 is connected to a fuel tank 19 via a fuel pump 18, and injects fuel into an intake passage of each cylinder. The fuel injection amount from the fuel injection valve 7 is controlled by the ECU 20. More specifically, in accordance with a control pulse signal from the ECU, the fuel injection valve 7 is opened for a time period corresponding to pulse width of the control pulse signal, and fuel of the corresponding amount is injected.

The fuel tank 19 is connected to a canister 12 via a valve 11, and the canister 12 is connected to the intake pipe 2 at a position downstream from the throttle valve 4 via a purge passage 13. The canister 12 includes an adsorbent 12*a* which adsorbs evaporated fuel (vapor) generated in the fuel tank 19, and an outside air intake port 12*b*. A purge control valve 14 which is an electromagnetic valve is provided on the purge passage 13, and opening and closing the purge control valve 14 is controlled in accordance with a signal from the ECU 20.

When the evaporated fuel generated inside the fuel tank 19 reaches predetermined pressure, it flows into the canister 12 through the valve 11, and adsorbed and stored by the adsorbent 12*a* in the canister 12. When the purge control valve 14 is opened by the control of the ECU 20, outside air is introduced into the canister 12 from the outside air intake port 12*b* by negative pressure inside the intake pipe 2. The evaporated fuel stored in the adsorbent 12*a* in the canister 12 is introduced into the intake pipe 2 via the purge passage 13 together with the outside air and is fed to each cylinder of the engine 1.

A body of the engine 1 is provided with a water temperature sensor 23 utilizing a thermistor or the like, and the water temperature sensor 23 detects cooling water temperature inside the engine 1 and supplies a corresponding electrical signal to the ECU 20. The engine 1 is provided with an engine speed (NE) sensor 24 (hereinafter, also called "NE sensor"). The NE sensor 24 is provided near a cam crankshaft not shown of the engine 1, generates a signal pulse (TDC pulse) for each predetermined rotational angle (180 degrees) of the crankshaft, and supplies the signal pulse to the ECU 20. The ECU 20 can calculate the number of engine revolution based on the signal pulse from the NE sensor 24. Meanwhile, an exhaust pipe 9 downstream from the engine 1 is provided with an oxygen ($O_2$) sensor 26. The oxygen sensor 26 detects oxygen concentration in exhaust gas in the exhaust pipe 9, and supplies a corresponding electrical signal to the ECU 20. The ECU 20 performs an air/fuel ratio feedback (feedback) control based on the oxygen concentration. An A/F sensor may be provided instead of the oxygen sensor 26. In this specification, the "oxygen concentration sensor" is the concept including the oxygen sensor and the A/F sensor. In the downstream side from the oxygen sensor 26, the exhaust pipe 9 is provided with a catalyst converter not shown.

The ECU 20 determines an operating state of the engine 1 based on the output signal from each sensor, and controls each component in accordance with necessity. Especially, in this embodiment, the ICU 20 controls the fuel injection amount by the fuel injection valve 7 and the execution/stop of purge by the purge control valve 14.

First Embodiment

Next, a first embodiment of the control apparatus for the internal combustion engine of the present invention will be explained. The first embodiment relates to the control in case of increasing fuel injection amount at the cold time (when the engine is not sufficiently warmed) at the engine starting time and the like, for example. At the cold time, evaporation of the fuel is insufficient even when a predetermined amount of fuel is injected from the fuel injection valve 7, the fuel adheres to an inner wall and the like of the intake pipe and the combustion chamber, and the amount of the fuel which does not contribute to combustion in the combustion chamber becomes large. Therefore, at the engine starting time and at the cold time, the fuel injection amount is increased. However, when the fuel is increased when the purge control of the aforementioned canister is performed, an error occurs to learning of the vapor concentration by purge, and precision is lowered. Therefore, in the first embodiment, after the fuel increase is performed after starting the engine, the fuel increase is quickly stopped at a point of time when the fuel increase amount is corrected by the feedback control, and thereafter, purge control is immediately started.

Figure 2:
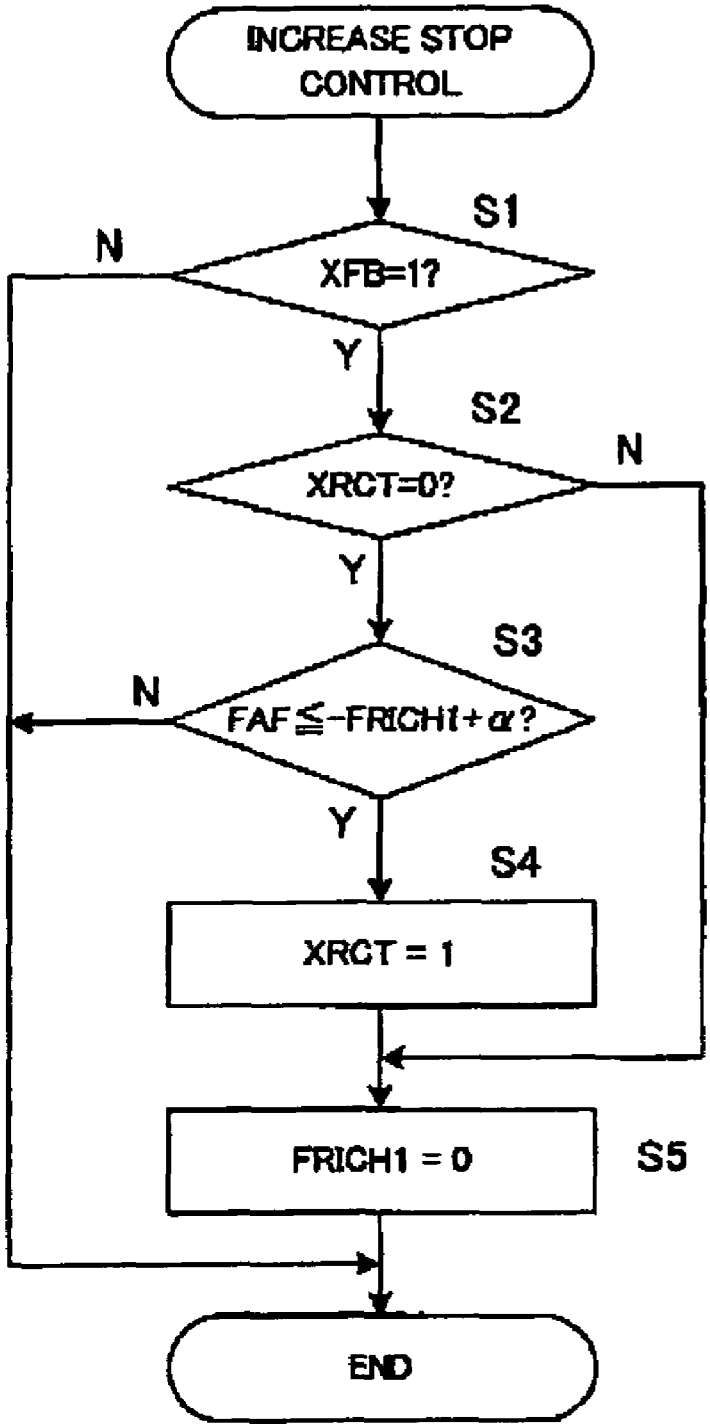
FIG. 2 is a flow chart of an increase stop control of the fuel in a first embodiment.
Figure 3:
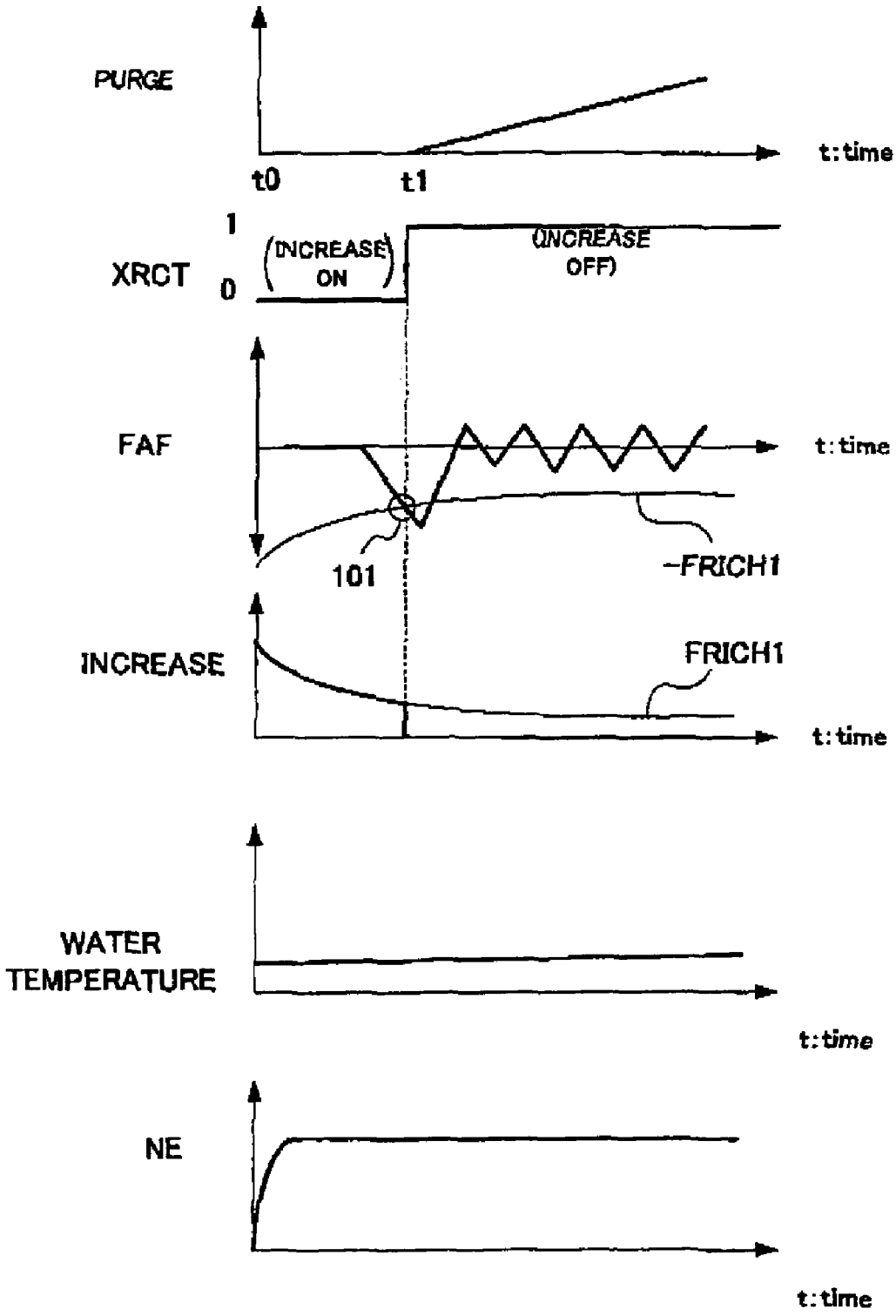
FIG. 3 is a timing chart of the increase stop control of the fuel in the first embodiment.

An example of the increase stop control according to the first embodiment is shown in FIG. 2 and FIG. 3. FIG. 2 is a flow chart of the increase stop control, and FIG. 3 is a timing chart explaining the increase stop control. FIG. 3 shows a start time of purge, increase flag XRCT, a feedback correction amount FAF, transition of fuel increase, transition of number of engine revolution (NE), and time course of water temperature. The increase flag XRCT shows that the fuel is not to be increased when it is "1", and shows that the fuel is to be increased when it is "0". The FRICH1 indicates the increase amount of the fuel.

In FIG. 3, after a starting time t0 of the engine 1, the fuel is increased in accordance with the graph FRICH1 indicating the increase amount of fuel. By the air/fuel ratio feedback control executed by the ECU 20, the feedback correction amount starts to change with a little delay from the time t0. The air/fuel ratio tends to be rich during fuel increase, and therefore the feedback correction amount FAF becomes negative. As the increase of the fuel proceeds, the feedback correction amount FAF increases in the negative direction, but when the feedback correction amount FAF reaches the correction Amount corresponding to the fuel increase amount, namely, at a time t1 when the feedback correction amount FAF intersects the graph "−FRICH1", the ECU 20 sets the increase flag XCRT to "1", and stops the increase of the fuel. After the feedback correction amount FAF reaches the correction amount corresponding to the increase amount, the air/fuel ratio is properly controlled by the air/fuel ratio feedback control, and therefore the increase of the fuel is immediately stopped. After the increase of the fuel is stopped, the influence by the fuel increase is not exerted on the learning of the vapor concentration even if purge control is executed, and therefore the purge control is started immediately after the increase of fuel is stopped. Namely, at the time of the start of the engine, the engine is quickly warmed by performing increase of the fuel at first, and the air/fuel ratio feedback control by the ECU 20 grasps the increase amount of the fuel. Then, after the feedback correction amount reaches the correction amount corresponding to the increase amount, the increase of the fuel is stopped quickly, and the purge control is started. As a result, the purge control is not performed during increase of the fuel, and therefore the fuel increase does not have an adverse effect on the learning of the vapor concentration during the purge control. After the increase amount is grasped by the air-fuel ratio feedback control after increase of the fuel, increase of the fuel is stopped quickly, and the purge control can be started as early as possible.

Next, increase of the fuel will be explained. FIG. 5B is an example of a map showing the fuel increase amount FRICH1 at the engine starting time. In this example, the fuel increase amount FRICH1 is given as the sum of a first start time increase amount FASE1, a second start time increase amount FASE2 and a water temperature increase amount FWL. Namely, the fuel increase amount is given by the following formula.

$$FRICH1=FWL+FASE1+FASE2 \quad (1)$$

Here, the first start tine increase amount FASE1 is the amount of increase which is performed only in the early time period from the engine starting time t0 to ta, and the second start time increase amount FASE2 is the amount of increase which is performed thereafter until the time tb. The water temperature increase amount FWL is the amount of increase which is performed in accordance with the cooling water temperature of the engine 1 at the cold time of the engine or the like, and this increase is performed until a time tc in this example.

Next, the increase control of the fuel will be explained with reference to a flow chart in FIG. 5A. The increase control is executed by the ECU 20 at the engine starting time or the like. First, the ECU 20 determines whether the increase flag XRCT is zero or not, namely, whether increase should be performed or not (step S21). Normally, the increase flag XRCT is set at zero at the starting time of the engine and the cold time. When the increase flag XRCT=0, the ECU 20 determines the fuel increase amount FRICH1 based on the graph shown in FIG. 5B, for example. More specifically, the ECU 20 determines the water temperature increase amount FWL based on the detected water temperature supplied from the water temperature sensor 23 (step S22). Next, the ECU 20 determines the first start time increase amount FASE1 by the following formula (step S23).

$$FASE1=FASE1-KASE1 \quad (2)$$

Figure 5A:
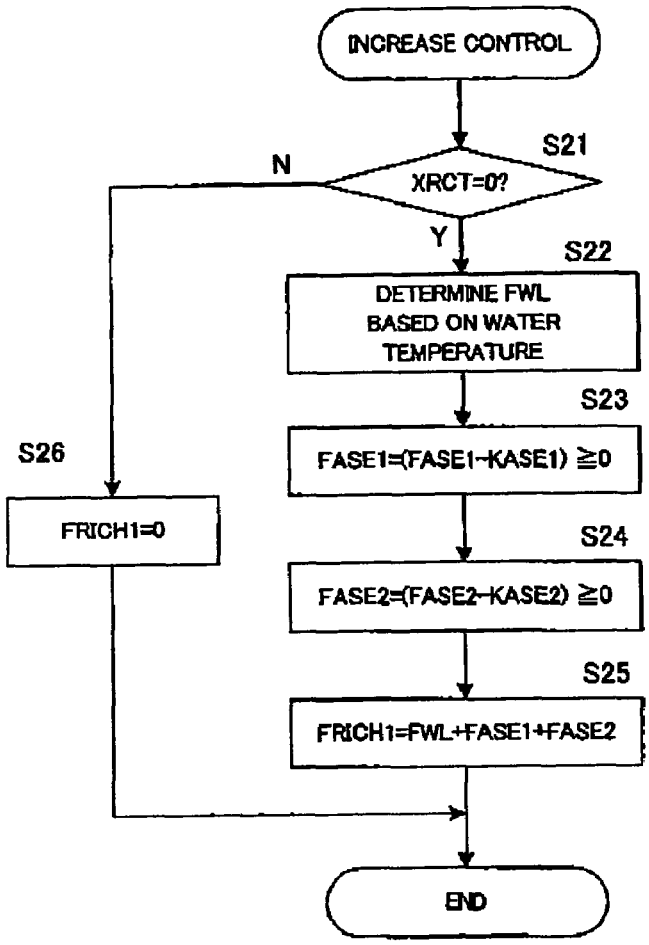
FIGS. 5A and 5B are a flow chart of the increase control of the fuel and an example of a map showing transition of the increase amount of the fuel in the first embodiment.
Figure 5B:
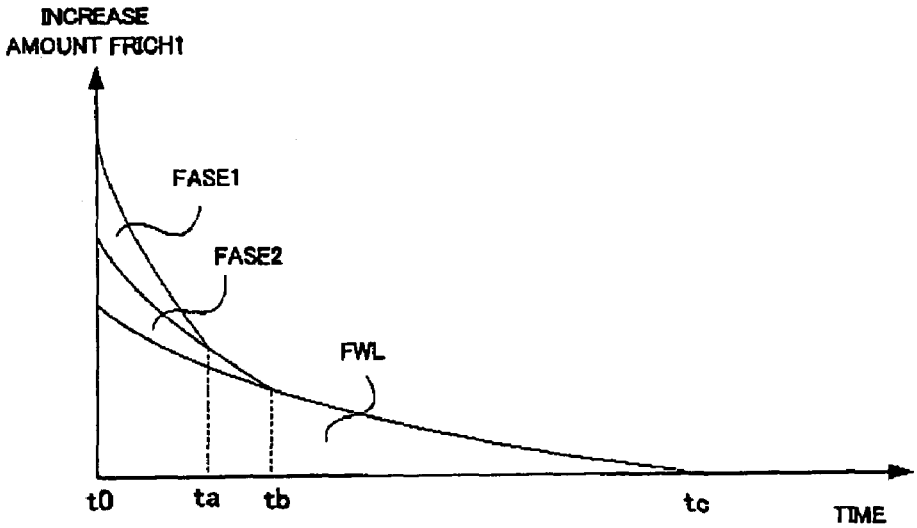

Here, KASE1 indicates a decrease amount of the first start time increase amount FASE1, and is a value which increases every predetermined time or every time the routine shown in FIG. 5A is executed.

Similarly, the ECU 20 determines the second start time increase amount FASE2 by the following formula (step S24).

$$FASE2=FASE2-KASE2 \quad (3)$$

Here, KASE2 indicates a decrease amount of the second start time increase amount FASE2, and is a value which increases every predetermined time or every time the routine shown in FIG. 5A is executed.

Next, the ECU 20 calculates the fuel increase amount FRICH1 in accordance with the above-described formula (1) (step S25). In this manner, the fuel is increased by the calculated amount and is injected to the intake passage from the fuel injection valve 7.

On the other hand, when the increase flag XRCT=0 is not satisfied in step S21, namely, when the fuel increase is not performed, the ECU 20 sets the fuel increase amount FRCIH1=0. As a result, the fuel injected from the fuel injection valve 7 is not increased.

Next, the increase stop control after the fuel is thus increased will be explained with reference to the flow chart in FIG. 2. First, the ECU 20 determines whether the feedback control flag XFB=1 or not, namely, whether the feedback control is under way or not (step S1). When the feedback control flag XFB is "1", the feedback control is under way, and when it is "0" the feedback control is not under way. When the feedback control is under way (step S1: Yes), the ECU 20 determines whether the increase flag XRCT=0 or not, namely, whether the increase of the fuel is under way or not (step S2). When the increase is under way (step S2; Yes), the ECU 20 determines whether the present feedback correction amount FAF reaches the correction amount corresponding to the fuel increase amount FRICH1 (step S3). More specifically, the ECU 20 determines whether or not the feedback correction amount FAF is larger than the correction amount obtained by adding a predetermined margin $\alpha$ to the increase amount FRICH1 of the fuel. This is the determination whether the feedback correction amount FAF is smaller than the correction amount (−FRICH1) corresponding to the fuel increase amount FRICH1 or not, as shown in a region 101 in FIG. 3. For example, when the fuel increase amount FRICH1 indicates the increase of 10%, and the above-described predetermined margin $\alpha$=−2%, it is determined that the feedback correction amount FAF reaches the correction amount corresponding to the fuel increase amount when the feedback correction amount FAF is smaller than −12%.

When the feedback correction amount FAF reaches the correction amount corresponding to the increase amount of the fuel (step S3; Yes), the ECU 20 sets the increase flag XRCT=1 (step S4), and further sets the fuel increase amount FRICH1=0 (step S5), and stops the increase of the fuel. In this manner, during fuel increase after starting the engine, when the feedback correction amount by the air/fuel ratio feedback control reaches the correction amount corresponding to the fuel increase amount, the increase of the fuel is stopped quickly.

When it is determined that the feedback control is not under way in step S1 (step S1; No), and when it is determined that the feedback correction amount FAF does not reach the correction amount corresponding to the fuel increase amount in step S3 (step S3; No), the ECU 20 terminates the processing. When it is determined that the increase is not under way in step S2 (step S2; No), the processing goes to step S5, and the processing is finished with setting the fuel increase amount FRICH1=0.

Figure 4:
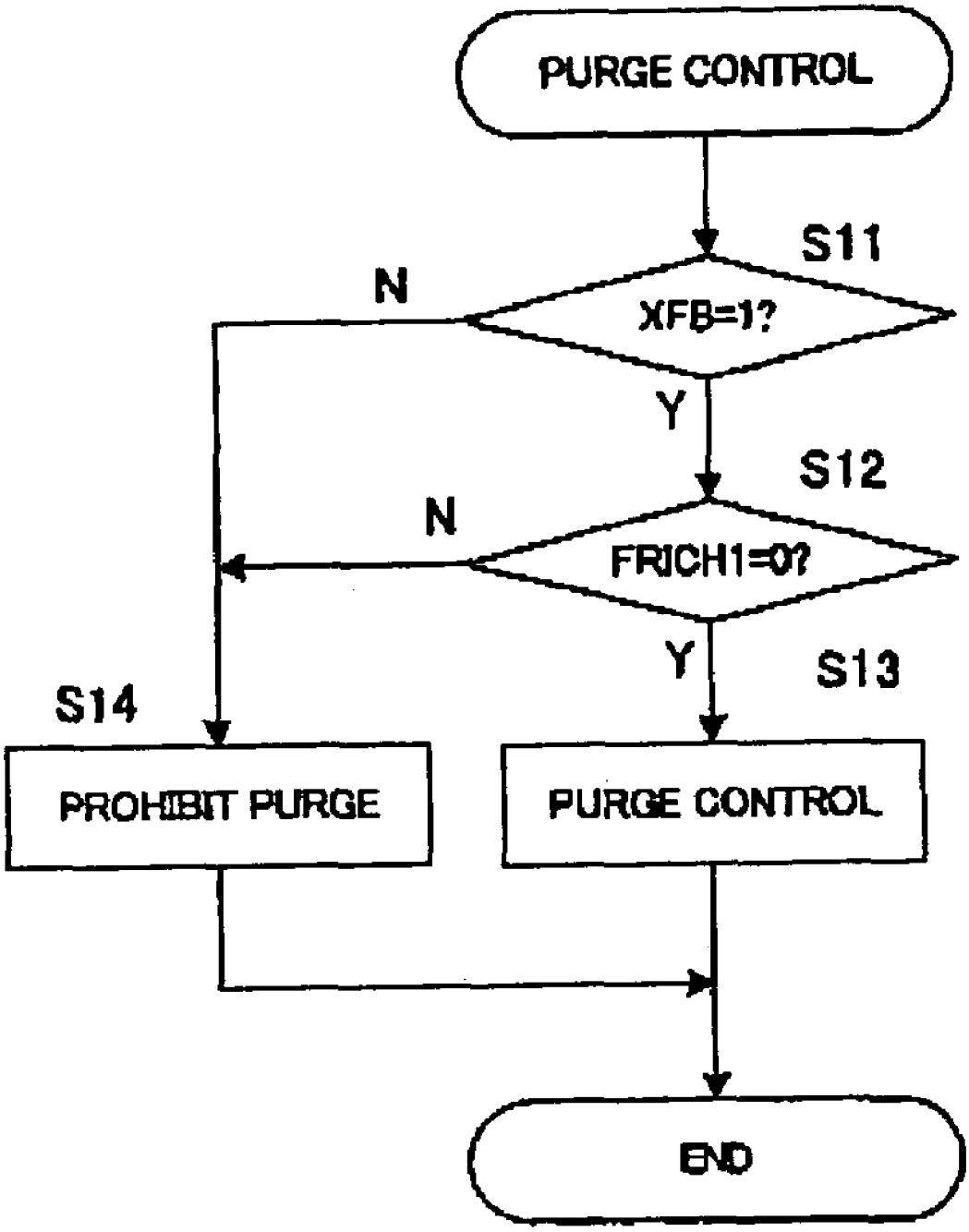
FIG. 4 is a flow chart of purge control in the first embodiment.

When the increase of the fuel is thus stopped by the increase stop control, the ECU 20 immediately executes the purge control shown in FIG. 4. Namely, the ECU 20 first determines whether the feedback control flag XFB=1, namely, the feedback control is under way or not (step S11). When the feedback control is under way (step S11; Yes), the ECU 20 determines whether the fuel increase amount FRICH1=0 or not (step S12), and when the fuel increase amount is zero (step S12; Yes), the ECU 20 executes the purge control (step S13).

On the other hand, when the fuel increase amount FRICH1=0 is not satisfied (step S12; No), the processing goes to step S14, and after the purge control is prohibited, the processing is finished. The purge control is generally executed during feedback control, and therefore, when it is determined that the feedback control is not under way in step S11 (step S11; No), the ECU 20 prohibits the purge control and finishes the processing (step S14).

As described above, according to the first embodiment, when the air/fuel ratio feedback control is performed at the engine starting time, the cold time and the like, and the fuel increase such as the start time increase is executed, the increase of the fuel is stopped and the purge control is performed quickly when the feedback correction amount reaches the correction amount corresponding to the fuel increase amount, namely, when the air/fuel ratio feedback control grasps the fuel increase amount and becomes controllable. Thereby, erroneous leaning of the vapor concentration during purge control, caused by the fuel increase, can be prevented, and it is possible to start purge control at an early stage after the start of the engine.

When the fuel is increased during feedback control, the feedback control range decreases due to the amount of fuel increase. However, at the point of time when the feedback correction amount reaches the feedback correction amount corresponding to the increase amount, the increase is stopped early, and therefore, the time period in which the feedback control is executed in the state with the narrow feedback control range can be shortened. Since the fuel increase is stopped at the point of time when the feedback control grasps the fuel increase amount, the increase of the fuel can be prevented from continuing uselessly thereafter.

Second Embodiment

Next, a second embodiment of the present invention will be explained. A first example to a third example which will be explained hereinafter are all predicated on the control of the first embodiment.

FIRST EXAMPLE

Figure 6:
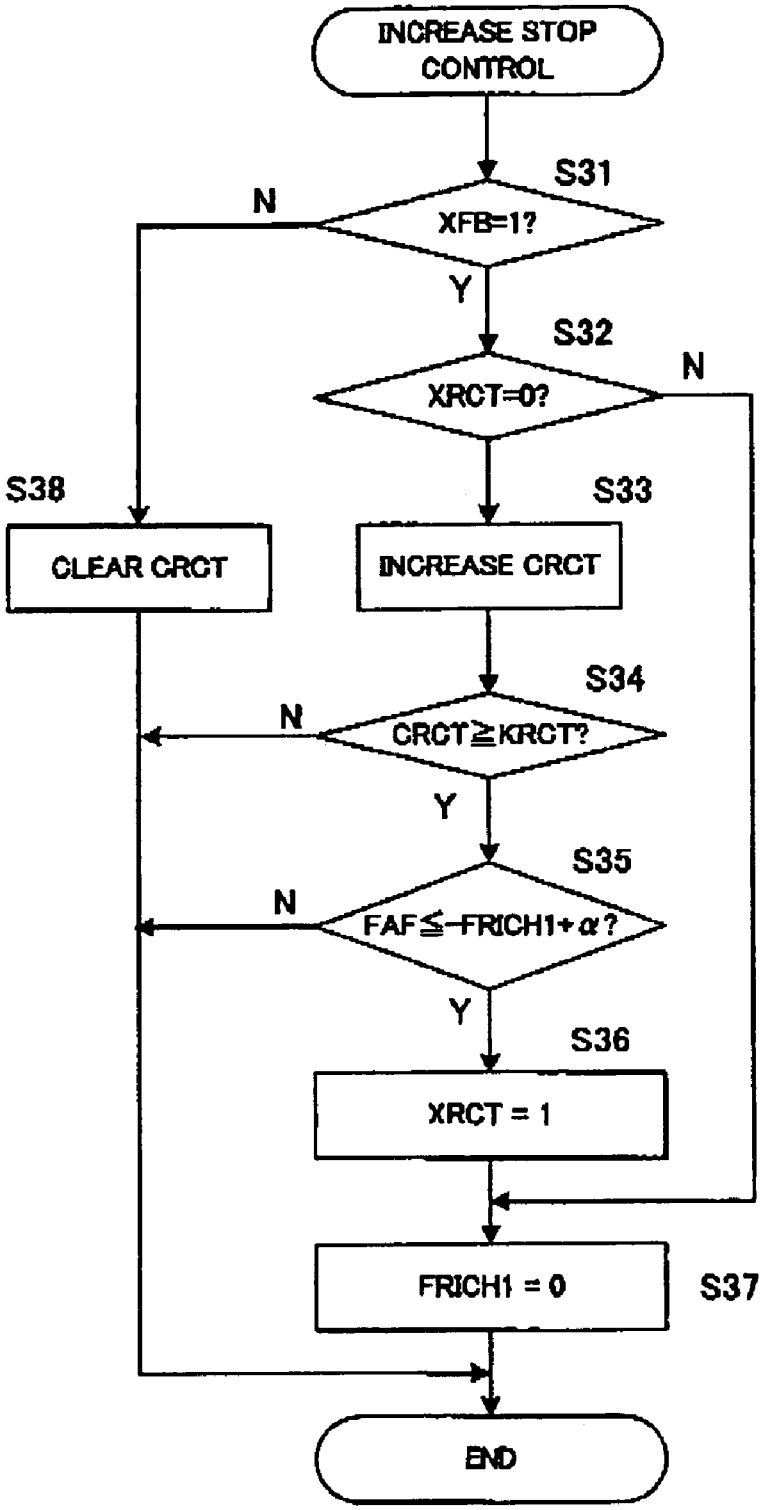
FIG. 6 is a flow chart of the increase stop control of the fuel in a first example of a second embodiment.
Figure 7:
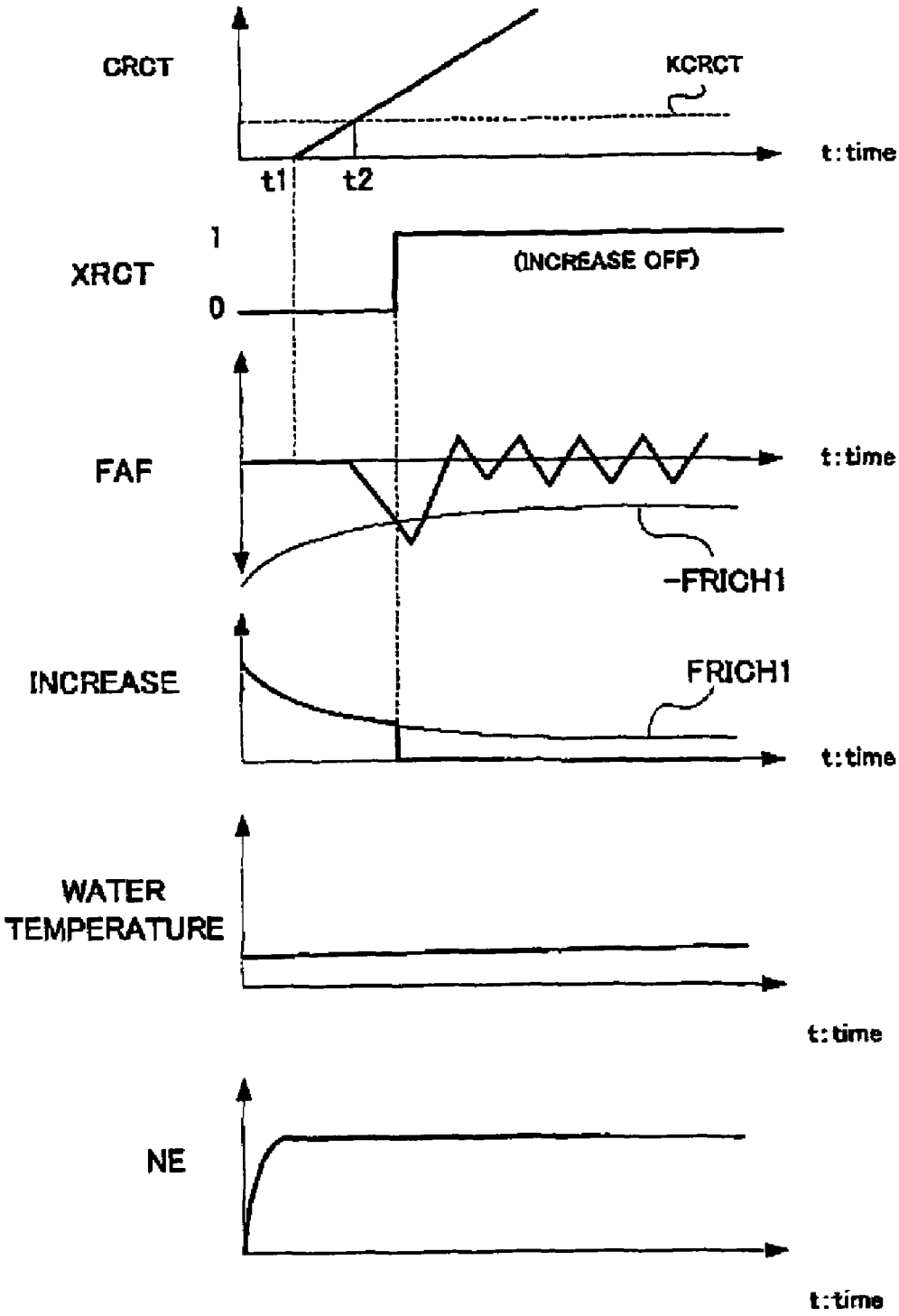
FIG. 7 is a timing chart of the increase stop control of the fuel in the first example of the second embodiment.

The first example of the second embodiment performs determination of whether or not the feedback correction amount FAF reaches the correction amount corresponding to the fuel increase amount FRICH1 after a predetermined time period elapses from the start of the feedback control. A flow chart of the control in the first example is shown in FIG. 6, and a timing chart is shown in FIG. 7.

More specifically, the ECU 20 counts the elapsed time after the start of the feedback control. This count value is set as "CRCT". The count value corresponding to the predetermined time is set as "KCRCT". In FIG. 7, the ECU 20 starts the feedback control at the time t1, and thereby, the count value CRCT increases. After the time t2 when the count value CRCT reaches the predetermined count value KCRCT, the ECU 20 determines whether or not the feedback correction amount FAF reaches the correction amount corresponding to the fuel increase amount FRICH1, as in the first embodiment. When the feedback correction amount FAF reaches the correction amount corresponding to the fuel increase amount FRICH1, the ECU 20 sets the increase flag XCRT at "1", and stops the increase of the fuel. The other respects are the same as in the first embodiment.

Next, the processing of the first example of the second embodiment will be explained with reference to the flow chart in FIG. 7. First, the ECU 20 determines whether the feedback control flag XFB=1 or not, namely, whether the feedback control is under way or not (step S31). When the feedback control is under way (step S31: Yes), the ECU 20 determines whether the increase flag XRCT=0 or not, namely, whether the fuel increase is under way or not (step S32). When the fuel increase is under way (step S32; Yes), the ECU 20 increases the count value CRCT indicating the elapsed time after the start of the feedback control (step S33), and determines whether the count value CRCT becomes equal to or larger than the predetermined count value KCRCT or not (step S34). When the count value CRCT becomes equal to or larger than the predetermined count value (step S34; Yes), the ECU 20 determines whether the present feedback correction amount FAF reaches the correction amount corresponding to the increase amount FRICH1 of the fuel or not (step S35), as in the first embodiment hereinafter.

When the correction amount reaches the correction amount corresponding to the increase amount of the fuel (step S35; Yes), the ECU 20 sets the increase flag XRCT=1 (step S36), and further sets the fuel increase amount FRICH1=0 (step S37), and stops the increase of the fuel. In this manner, the increase of the fuel is stopped quickly when the feedback correction amount by the air/fuel ratio feedback control reaches the correction amount corresponding to the fuel increase amount during fuel increase after the start of the engine or the like.

When it is determined that the feedback control is not under way in step S31 (step S31; No), the ECU 20 clears the count value CRCT (step S38).

After the increase of the fuel is stopped by the increase stop control in this manner, the ECU 20 can immediately execute the purge control as in the first embodiment.

As described above, according to the first example of the second embodiment, the determination of whether the feedback control amount reaches the correction amount corresponding to the fuel increase amount or not is performed after the predetermined time elapses from the start of the feedback control. Therefore, the determination precision can be enhanced by avoiding the time period, in which the detection precision of the oxygen concentration sensor is comparatively low, at the early stage after the start of the feedback control.

SECOND EXAMPLE

A second example of the second embodiment dose not perform determination of whether the feedback control amount reaches the correction amount corresponding to the fuel increase amount or not during decelerating operation of the vehicle, namely, during deceleration of the engine. Since the negative pressure inside the intake pipe increases at the time of deceleration of the vehicle, the fuel adhering to the inner wall of the intake pipe or the like is introduced into the combustion chamber at a dash, and the air/fuel ratio tends to be in a rich state. Therefore, an error easily occurs to the determination of the correction amount in such a state. As a result, the determination of whether the feedback control amount FAF reaches the correction amount corresponding to the fuel increase amount FRICH1 or not is not performed at the time of deceleration of the vehicle. The ECU 20 can determine whether the vehicle is under deceleration or not based on, for example, the output from the NE sensor 24, the output from the vehicle speed sensor and the like.

Figure 8:
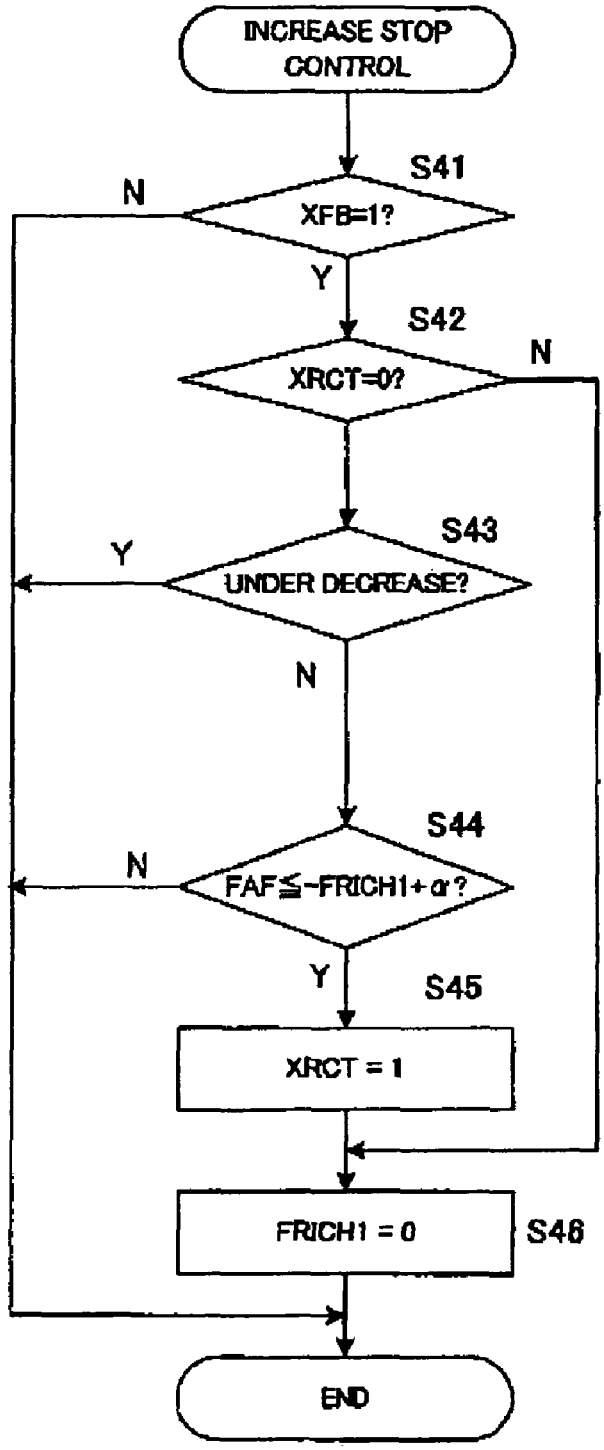
FIG. 8 is a flow chart of the increase stop control of the fuel in a second example of the second embodiment.

Next, processing of the second example of the second embodiment will be explained with reference to a flow chart of FIG. 8. First, the ECU 20 determines whether the feedback control flag XFB=1 or not, namely, whether the feedback control is under way or not (step S41). When the feedback control is under way (step S41: Yes), the ECU 20 determines whether the increase flag XRCT=0 or not, namely, whether increase of fuel is under way or not (step S42). When the increase of fuel is under way (step S42; Yes), the ECU 20, determines whether the vehicle is under deceleration or not based on the output from the vehicle sensor or the like (step S43). When the vehicle is under deceleration (step S43; Yes), the processing is terminated. On the other hand, when the vehicle is not under deceleration (step S43; No), the ECU 20 determines whether the present feedback correction amount FAF reaches the correction amount corresponding to the increase amount FRICH1 of the fuel or not, as in the first embodiment (step S44).

When the present feedback correction amount FAF reaches the correction amount corresponding to the increase amount of the fuel (step S44; Yes), the ECU 20 sets the increase flag XRCT=1 (step S45), and further sets the fuel increase amount FRICH1=0 (step S46), and stops increase of the fuel. In this manner, increase of the fuel is stopped quickly when the feedback correction amount by the air/fuel ratio feedback control reaches the correction amount corresponding to the fuel increase amount.

When it is determined that the feedback control is not under way in step S41 (step S41; No), the ECU 20 immediately terminates the processing. In this manner, the ECU 20 can immediately execute purge control as in the first embodiment after increase of the fuel is stopped by the increase stop control.

As described above, according to the second example of the second embodiment, the determination of whether the feedback control amount reaches the correction amount corresponding to the fuel increase amount or not is not performed during deceleration of the vehicle. As a result, erroneous determination of the increase stopping time, caused by the air/fuel ratio becoming temporarily rich at the time of deceleration, can be prevented.

THIRD EXAMPLE

A third example of the second embodiment does not perform the determination of whether the feedback control amount FAF reaches the correction amount corresponding to the fuel increase amount or not when the load variation of the engine is large. When the load variation of the engine is large at the accelerating time of the vehicle, decelerating time and the like, the amount of fuel introduced into the combustion chamber becomes unstable, and therefore an error easily occurs to the determination of the increase stopping time. Therefore, when the load variation of the engine is large, the determination of whether the feedback control amount FAF reaches the correction amount corresponding to the fuel increase amount or not, namely, the determination of the increase stopping time is not performed. The load variation of the engine can be determined based on, for example, the variation of the negative pressure inside the intake pipe detected by the pressure sensor 21, the variation of the throttle opening degree detected by the throttle opening degree sensor 27, and the like.

Figure 9:
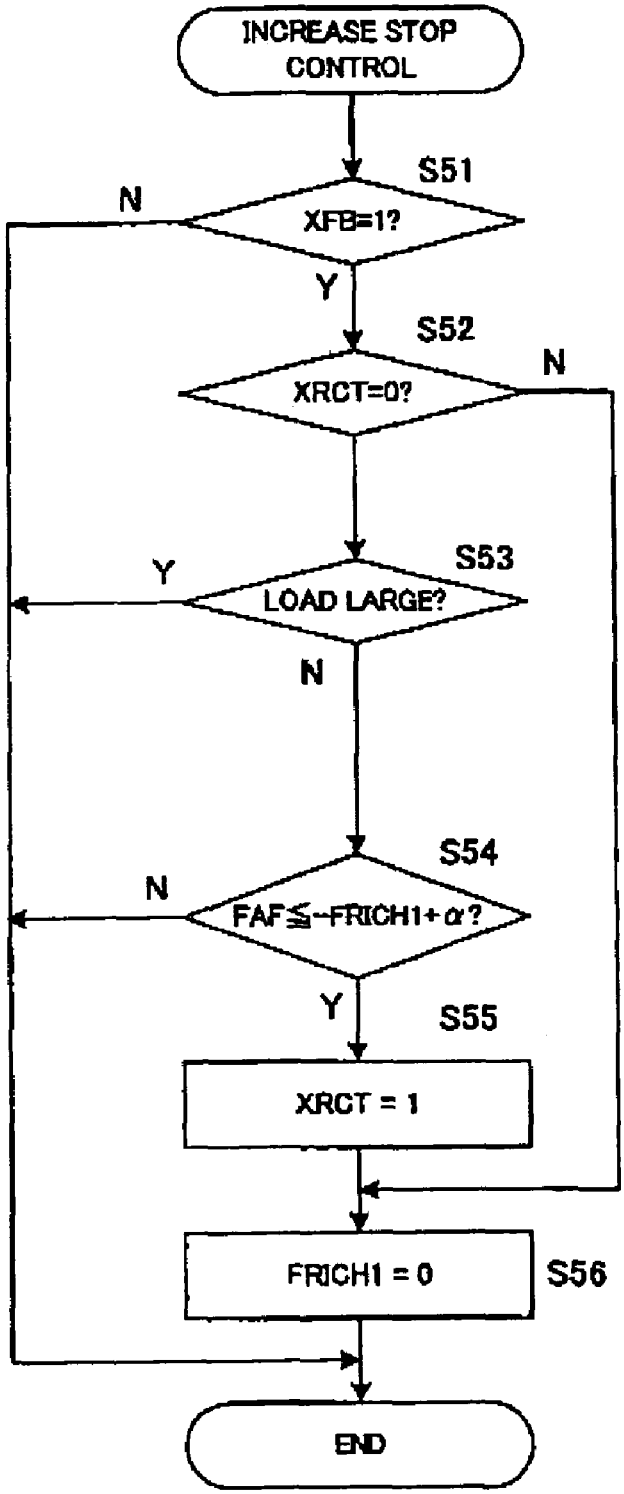
FIG. 9 is a flow chart of the increase stop control of the fuel in a third example of the second embodiment.

Next, processing of a third example of the second embodiment will be explained with reference to a flow chart in FIG. 9. First, the ECU 20 determines whether the feedback control flag XFB=1 or not, namely, whether the feedback control is under way or not (step S51). When the feedback control is under way (step S51: Yes), the ECU 20 determines whether the increase flag XRCT=0 or not, namely, whether increase of the fuel is under way or not (step S52). When increase is under way (step S52; Yes), the ECU 20 determines whether the load of the engine is larger than the predetermined value or not based on the outputs of the pressure sensor 21 provided in the intake pipe, the throttle opening degree sensor 27 and the like (step S53). When the load of the engine is larger than the predetermined value (step S53; Yes), the processing is terminated.

On the other hand, the load of the engine is smaller than the predetermined value (step 353; No), the ECU 20 determines whether the present feedback correction amount FAF reaches the correction amount corresponding to the increase amount FRICH1 or not, as in the first embodiment (step S54). When the present feedback correction amount FAF reaches the correction amount corresponding to the increase amount of the fuel (step S54; Yes), the ECU 20 sets the increase flag XRCT=1 (step S55), further sets the fuel increase amount FRICH1=0 (step S56), and stops increase of the fuel. In this manner, increase of the fuel is stopped quickly when the feedback correction amount by the air/fuel ratio feedback control reaches the correction amount corresponding to the fuel increase amount.

When it is determined that the feedback control is not under way in step S51 (step S51; No), the ECU 20 immediately terminates the processing. In this manner, the ECU 20 can immediately execute purge control, as in the first embodiment, after the increase of the fuel is stopped by the increase stop control.

As described above, according to the third example of the second embodiment, when the load variation of the engine is large during abrupt acceleration or deceleration, or in the other states, the determination of whether the feedback control amount reaches the correction amount corresponding to the fuel increase amount or not is not performed. Thereby, it can be prevented that determination precision of the increase stopping time is lowered as the result that the fuel supply amount varies due to change of the engine load.

Third Embodiment

Next, the third embodiment of the present invention will be explained. The third embodiment is predicated on the first embodiment, and is intended for performing more accurate determination of whether the feedback correction amount FAF reaches the correction amount corresponding to the fuel increase amount or not.

FIRST EXAMPLE

In a first example, the feedback correction amount FAF is successively detected, and its average value, more specifically, an average value FAFAV with the feedback correction amount of the previous time is calculated, and it is determined whether the average value FAFAV reaches the correction amount corresponding to the fuel increase amount FRICH1 or not. The average value FAFAV of the feedback correction amount FAF is the average value of the feedback correction amount FAF of the previous time and the feedback correction amount FAF of this time. The ECU 20 stores at least the feedback correction value FAF of the previous time in a memory or the like not shown, calculates the average value of the previous feedback correction value FAF and the feedback correction value FAF of this time, and performs determination.

Figure 10:
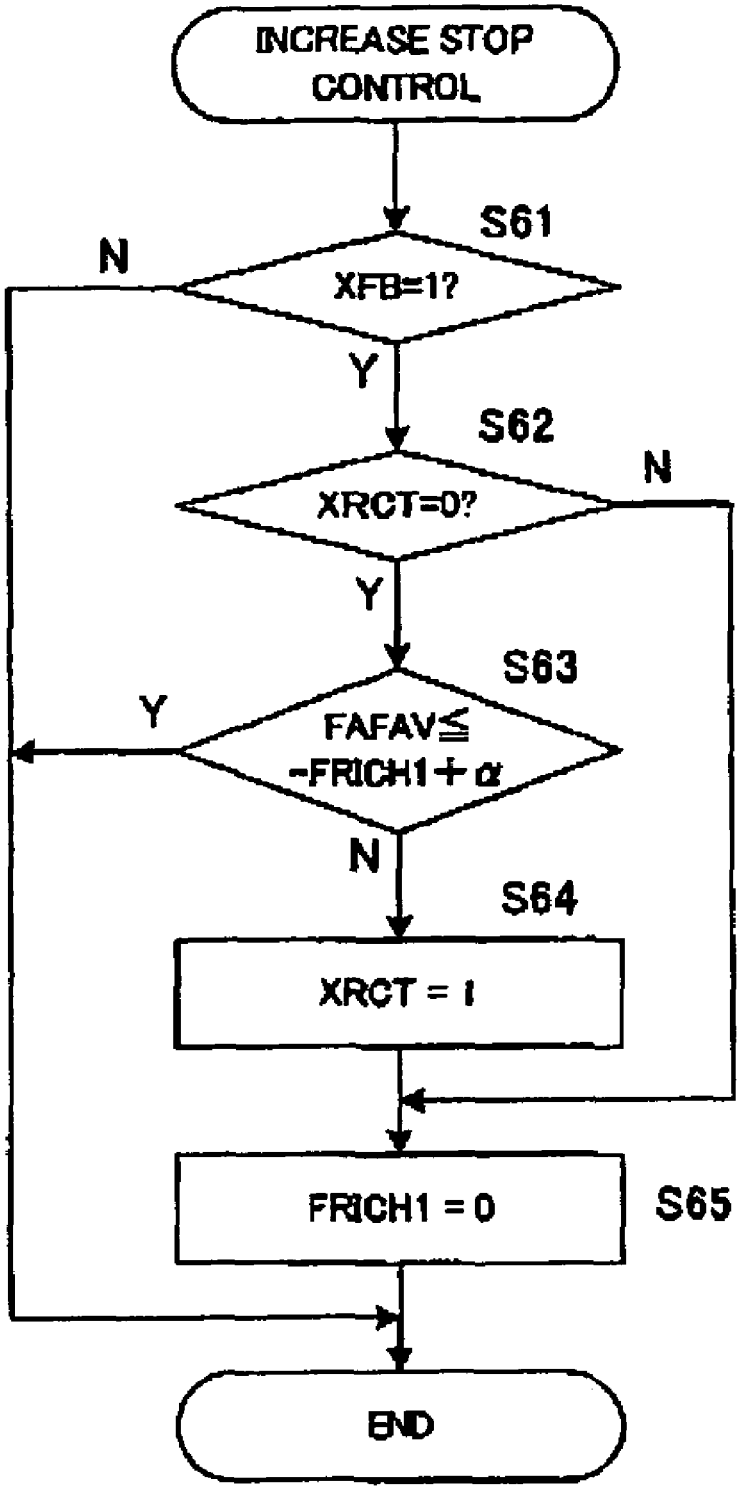
FIG. 10 is a flow chart of the increase stop control of the fuel in a first example of a third embodiment.

Next, increase stop control of the first example will be explained. A flow chart of the increase stop control of the first example of the third embodiment is shown in FIG. 10. First, the ECU 20 determines whether the feedback control flag XFB=1 or not, namely, whether the feedback control is under way or not (step S61). When the feedback control is under way (step S61: Yes), the ECU 20 determines whether the increase flag XRCT=0 or not, namely, whether the fuel is under increase or not (step S62). When the fuel is under increase (step S62; Yes), the ECU 20 determines whether the average value FAFAV of the feedback correction amount FAF reaches the correction amount corresponding to the increase amount FRICH1 of the fuel or not (step S63).

When the average value FAFAV of the feedback correction amount FAF reaches the correction amount corresponding to the increase amount FRICH1 of the fuel (step S63; Yes), the ECU 20 sets the increase flag XRCT=1 (step S64), and further sets the fuel increase amount FRICH1=0 (step S65), and stops increase of the fuel. In this manner, the ECU 20 stops increase of the fuel quickly when the feedback correction amount by the air-fuel ratio feedback control reaches the correction amount corresponding to the fuel increase amount.

When it is determined that the feedback control is not under way in step S61 (step S61; No), the ECU 20 immediately terminates the processing. In this manner, the ECU 20 can immediately execute purge control, as in the first embodiment, after increase of the fuel is stopped by the increase stop control.

As described above, according to the first example of the third embodiment, the feedback correction amount FAF is successively detected and its average value, more specifically, the average value FAFAV with the feedback correction amount FAF of the previous time is calculated, and it is determined whether the average value FAFAV reaches the correction amount corresponding to the fuel increase amount FRICH1 or not. Therefore, even when the feedback correction amount FAF is varied due to temporary causes of error, determination of the feedback correction amount is performed by using the average value, and therefore determination can be performed accurately.

In the above-described example, the average of the present feedback correction amount and the feedback correction amount just before the present feedback correction amount is used, but the average value of three or more past feedback correction amounts from the present feedback correction amount may be used.

SECOND EXAMPLE

The second example determines that the feedback correction amount FAF reaches the correction amount corresponding to the fuel increase amount when the feedback control becomes stable. However, in the second example, the number of positive and negative inversions of the feedback correction amount FAF (also called "the number of skips") is counted, and when the number of skips exceeds a predetermined number, it is determined that the feedback control is stabilized. More specifically, the ECU 20 counts the number of skips of the feedback correction amount, namely, a number CSKP of positive and negative inversions of the feedback correction amount, and determines that the feedback correction amount FAF reaches the correction amount corresponding to the fuel increase amount when the number CSKP of positive and negative inversions becomes equal to or larger than a predetermined number KCSKP of skips.

Figure 11:
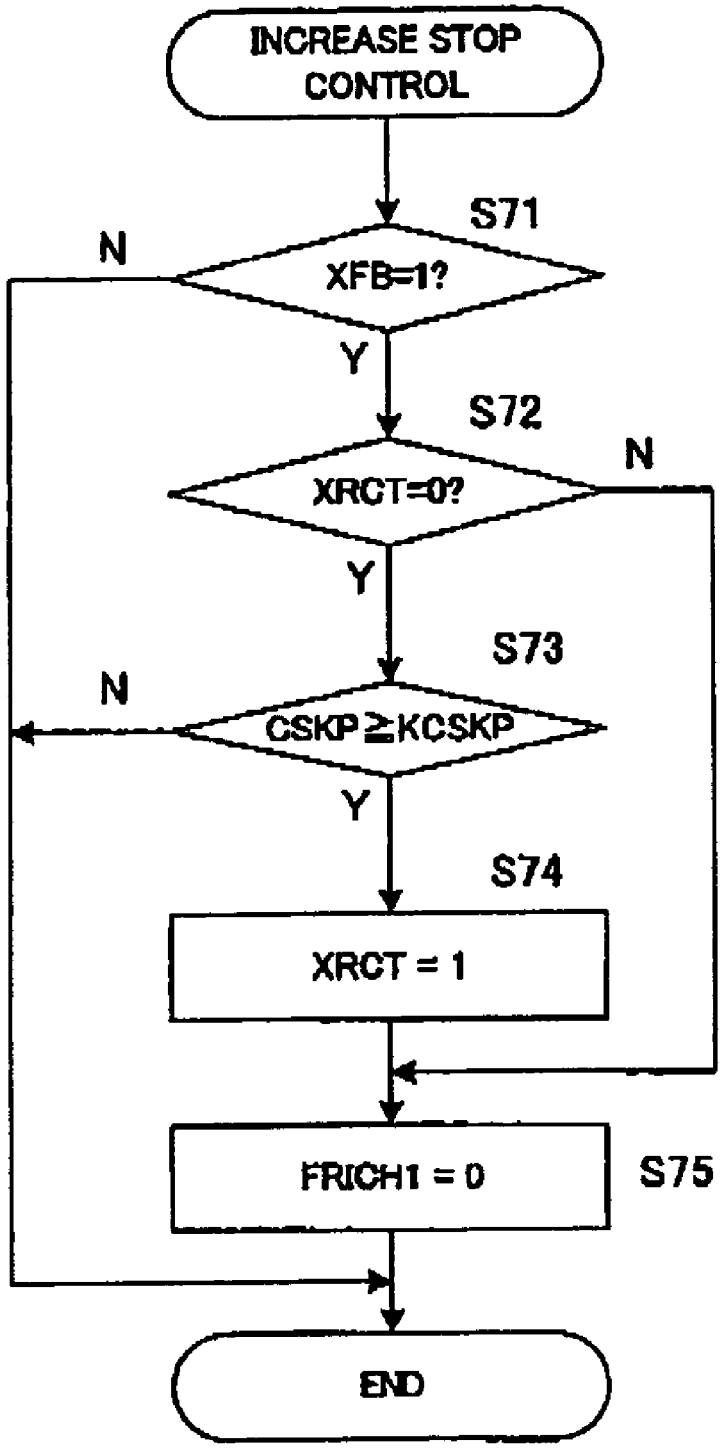
FIG. 11 is a flow chart of the increase stop control of the fuel in a second example of the third embodiment.

Next, increase stop control of the second example will be explained. A flow chart of the increase stop control of the second example of the third embodiment is shown in FIG. 11. First, the ECU 20 determines whether the feedback control flag XFB=1 or not, namely, whether the feedback control is under way or not (step S71). When the feedback control is under way (step S71: Yes), the ECU 20 determines whether the increase flag XRCT=0 or not, namely, determines whether the fuel is under increase or not (step S72). When the fuel is under increase (step S72; Yes), the ECU 20 determines whether the number CSKP of skips of the feedback correction amount becomes equal to or larger than the predetermined number KSCKP of skips or not (step S73).

When the number CSKP of skips of the feedback correction amount becomes equal to or larger than the predetermined number KSCKP of skips (step S73; Yes), the ECU 20 determines that the present feedback correction amount FAF reaches the correction amount corresponding to the increase amount FRICH1 of the fuel. Therefore, the ECU 20 sets the increase flag XRCT=1 (step S74), and further sets the fuel increase amount FRICH1=0 (step S75), and stops increase of the fuel. In this manner, the ECU stops increase of the fuel quickly when the feedback correction amount by the air/fuel ratio feedback control reaches the correction amount corresponding to the fuel increase amount.

When it is determined that the feedback control is not under way in step S71 (step S71; No), the ECU 20 immediately terminates the processing. When it is determined that the increase flag XCT=0 is not satisfied in step S72, the fuel increase amount FRICH1=0 is set in step S75 and the processing is finished. After increase of the fuel is stopped by the increase stop control, the ECU 20 can immediately execute the purge control as in the first embodiment.

As described above, according to the second example of the third embodiment, precision of the determination can be enhanced by determining that the feedback correction amount FAF reaches the correction amount corresponding to the fuel increase amount FRICH1 when the number of skips of the feedback correction amount becomes equal to or larger than the predetermined number.

Fourth Embodiment

Next, a fourth embodiment of the present invention will be explained. The fourth embodiment is predicated on the increase stop control which is explained so far, and performs increase stop control after fuel increase is started again when fuel cut (hereinafter, called "F/C") is performed during travel of the vehicle.

F/C is executed generally when a predetermined F/C condition is satisfied during travel of the vehicle. As the F/C condition, for example, the condition that the throttle opening degree is fully closed and the number of engine revolution is higher than predetermined number speed, or the like is used. Since fuel injection is stopped at the time of F/C, fuel adhering to the wall surface of the intake pipe or the like of the engine is consumed and the fuel decreases. Therefore, there is less adhering fuel to the wall surface when fuel injection is restarted after F/C, and it is therefore preferable to increase fuel injection amount, like the time of start of the engine or the like. Thus, after F/C is executed during travel of the vehicle, increase of the injection fuel and feedback control are carried out in accordance with each of the embodiments explained so far, and fuel increase is stopped at a point of time when the feedback control is executed with the feedback correction amount corresponding to the increase amount of the fuel. Namely, after F/C, increase stop control is performed after the fuel increase is performed similarly to the time of the start of the engine.

Figure 13:
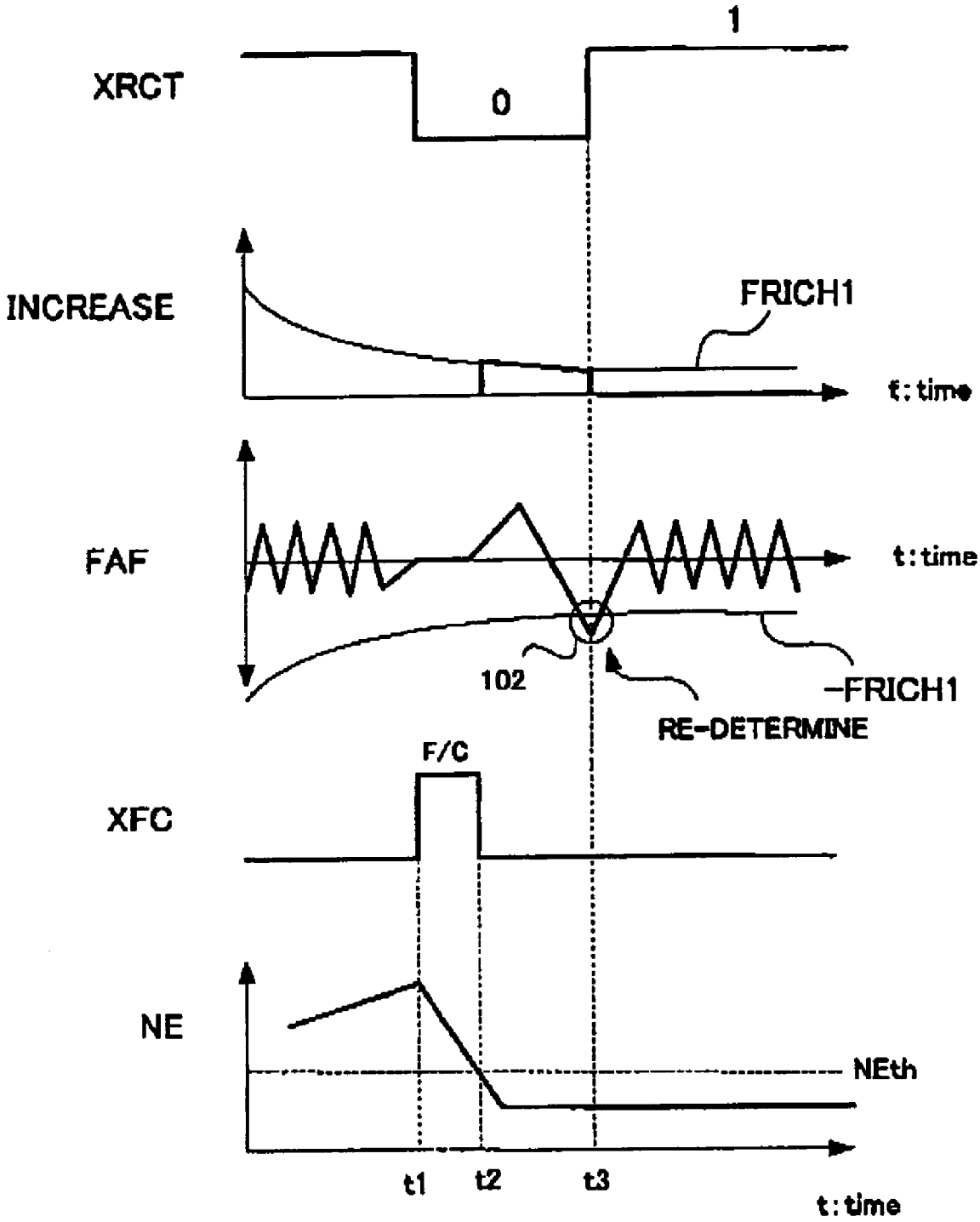
FIG. 13 is a timing chart of the increase stop control of the fuel in the fourth embodiment.

FIG. 13 shows one example of a timing chart of the increase stop control according to the fourth embodiment. In FIG. 13, an F/C flag XFC indicates that F/C is under execution when the F/C flag XFC is "1", and the F/C flag XFC indicates that F/C is not under execution when it is "0". The F/C condition is satisfied at the time t1, and the ECU 20 executes F/C. Thereafter, at the time t2 when the number of engine revolution NE lowers to a predetermined number of engine revolution NE or lower, the ECU 20 terminates F/C. At the same time, the ECU 20 restarts feedback control, and stops increase of the fuel at the time t3 when the feedback correction amount FAF becomes the correction amount corresponding to the fuel increase amount FRICH1.

Figure 12:
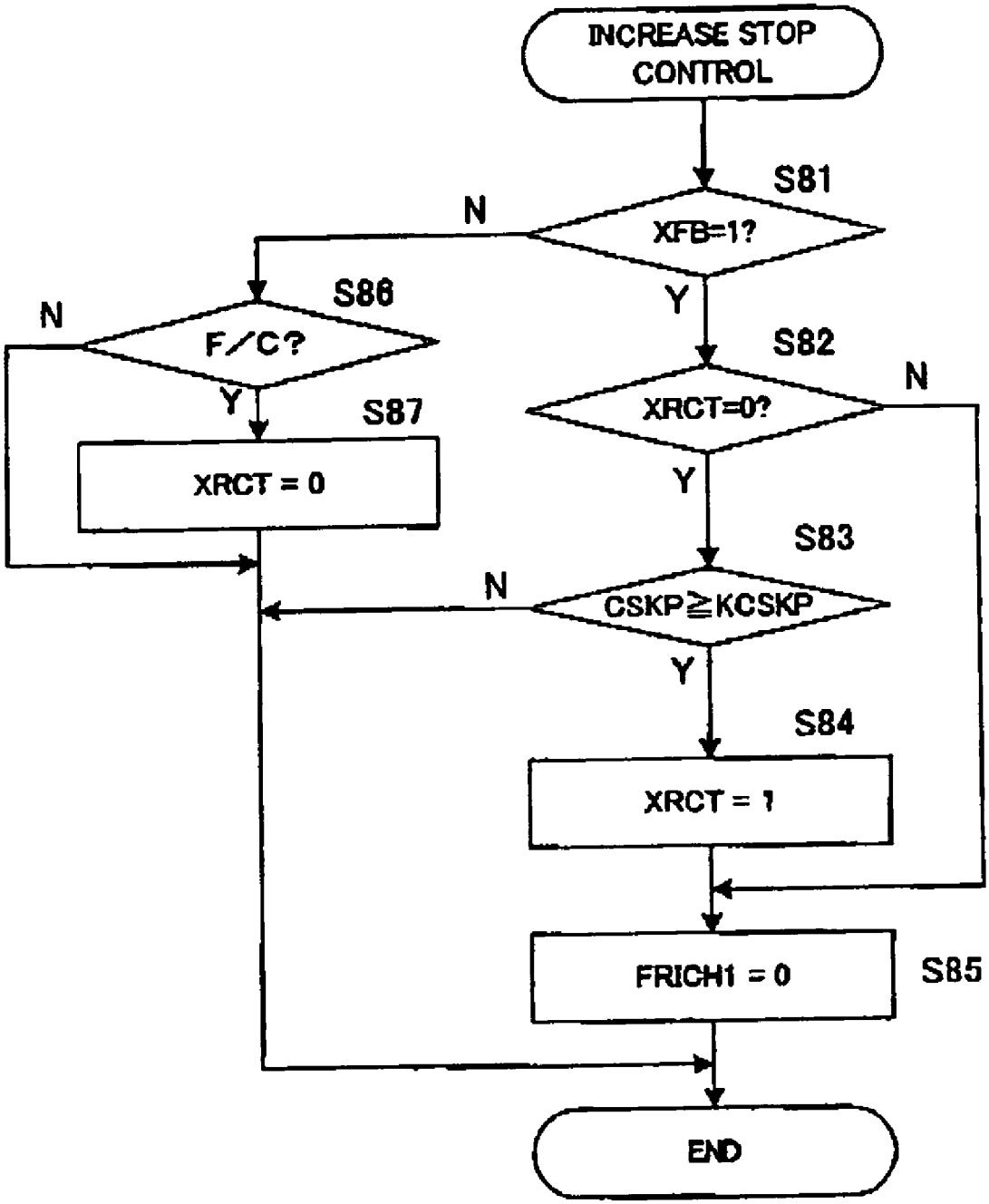
FIG. 12 is a flow chart of the increase stop control of the fuel in a fourth embodiment.

Next, the increase stop control of the fourth embodiment will be explained. The flow chart of the increase stop control of the fourth embodiment is shown in FIG. 12. First, the ECU 20 determines whether the feedback control flag XFB=1 or not, namely, whether the feedback control is under way or not (step S81). When the feedback control is under way (step S81: Yes), the ECU 20 determines whether the increase flag XRCT=0 or not, namely, whether the fuel is under increase or not (step S82). When the fuel is under increase (step S82; Yes), the ECU 20 determines whether the number CSKP of skips of the feedback correction amount becomes equal to or larger than the number KSCKP of skips or not (step S83).

When the number CSKP of skips of the feedback correction amount becomes equal to or larger than the predetermined number of skips (step S83: Yes), the ECU 20 determines that the present feedback correction amount FAF reaches the correction amount corresponding to the increase amount FRICH1 of the fuel. Therefore, the ECU 20 sets the increase flag XRCT=1 (step S84), further sets the fuel increase amount FRICH1=0 (step S85), and stops increase of the fuel. In this manner, the ECU 20 stops increase of the fuel quickly when the feedback correction amount by the air/fuel ratio feedback control reaches the correction amount corresponding to the fuel increase amount.

On the other hand, when it is determined that the feedback control is not under way in step S81 (step S81; No), the ECU 20 determines whether F/C is under way or not (step S86). When F/C is under way, the ECU 20 sets the increase flag XRCT=0 (step S87).

Thus, once F/C is executed, the increase flag XRCT=0 is set in step S87. Thereby, when feedback control is executed thereafter, the processing goes to steps S81 to 585, and after fuel increase is performed similarly to the time of start of the engine or the like, fuel increase is stopped at the point of time when feedback control becomes controllable corresponding to the fuel increase amount.

According to the fourth embodiment, fuel stop control is performed in this manner after fuel increase is performed again after carrying out F/C, worsening of combustion after restart of feedback can be prevented when less fuel adheres to the wall surface of the intake passage after carrying out F/C.

In the example in FIG. 12, determination of whether the feedback control corresponds to the fuel increase amount or not is performed based on the number of skips of the feedback correction amount as in the second example of the third embodiment, but instead of this, the same determination can be performed by determining whether the feedback correction amount FAF reaches the correction amount corresponding to the fuel increase amount FRICH1 or not, as in the first embodiment and the like.

Fifth Embodiment

Next, a fifth embodiment of the present invention will be explained. The fourth embodiment relates to increase control when the feedback control is released (opened) by F/C, but the fifth embodiment relates to processing when the feedback control is released at the time of throttle full open acceleration or the like. As described above, fuel injection is stopped during F/C, and the fuel adhering to the wall surface of the intake passage decreases after F/C. Therefore, after F/C, it is preferable to perform increase stop control after fuel increase is performed as shown in the fourth embodiment. On the other hand, at the time of control of a type which increases the fuel injection amount, such as the throttle full open acceleration or the like (hereinafter, called "fuel increase for power"), the fuel adhering to the wall surface does not decrease even when the feedback control is similarly released, and it is therefore not necessary to perform fuel increase again, unlike the case after F/C. Thus, even at the time of release of the feedback control, feedback control is immediately restarted without executing fuel increase such as increase at the time of start, after the fuel increase for power. The fuel increase for power include power increase, OTP increase, small air amount increase and the like.

Figure 15:
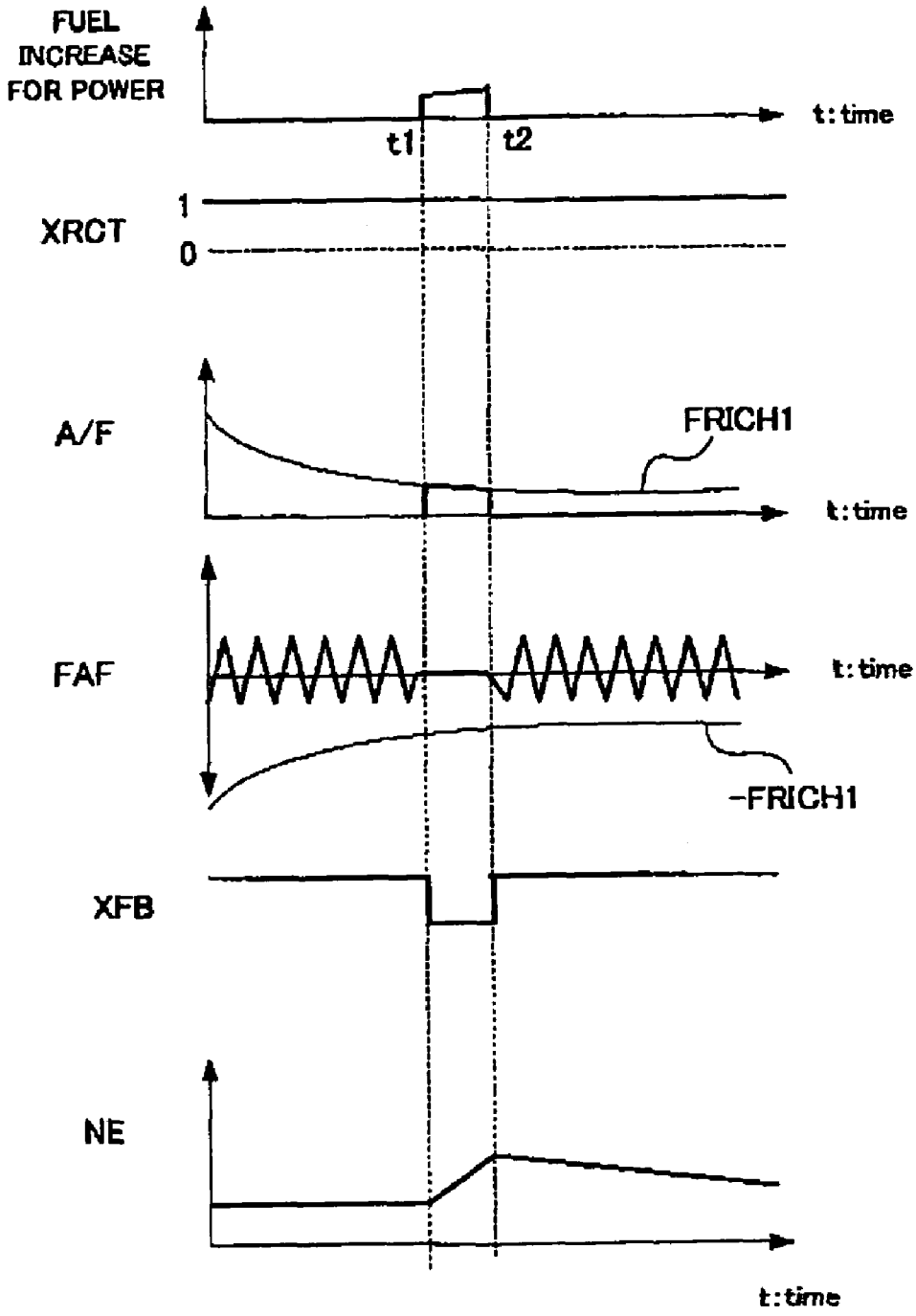
FIG. 15 is a timing chart of the increase stop control of the fuel in the fifth embodiment.

FIG. 15 shows a timing chart of such a control example. When the fuel increase for power is performed by fully opening the throttle and the like at the time t1, the feedback loop becomes open in this time period (See XFB), A/F becomes a rich state, and the number NE of engine revolution increases. Thereafter, when the fuel increase for power finishes at the time t2, the feedback loop is closed (See XFB), and feedback control is restarted.

Figure 14:
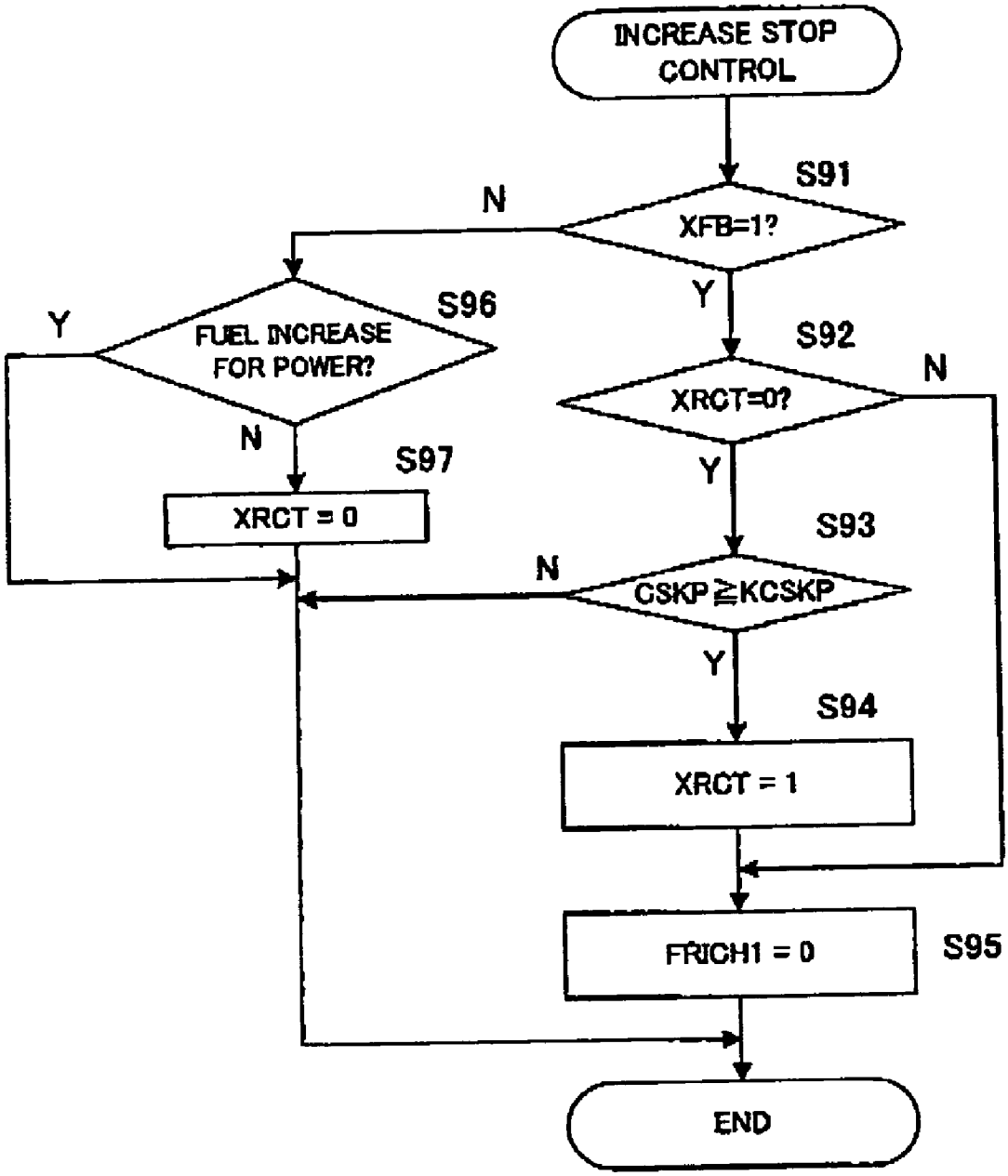
FIG. 14 is a flow chart of the increase stop control of the fuel in a fifth embodiment.

Next, increase stop control of the fifth embodiment will be explained. A flow chart of the increase stop control of the fifth embodiment is shown in FIG. 14. First, the ECU 20 determines whether the feedback control flag XFB=1 or not, namely, whether feedback control is underway or not (step S91). When the feedback control is underway (step S91: Yes), the ECU 20 determines whether the increase flag XRCT=0 or not, namely, whether the fuel is under increase or not (step S92). When the increase is under way (step S92; Yes), the ECU 20 determines whether the number CSKP of skips of the feedback correction amount becomes equal to or larger than the predetermined number KSCKP of skips (step S93).

When the number CSKP of skips of the feedback correction amount becomes equal to or larger than the predetermined number KSCKP of skips (step S93; Yes), the ECU 20 determines that the present feedback correction amount FAF reaches the correction amount corresponding to the increase amount FRICH1 of the fuel. Therefore, the ECU 20 sets the increase flag XRCT=1 (step S94), further sets the fuel increase amount FRICH1=0 (step S95), and stops increase of the fuel. In this manner, the ECU 20 stops increase of the fuel quickly when the feedback correction amount by the air/fuel ratio feedback control reaches the correction amount corresponding to the fuel increase amount.

On the other hand, when it is determined that feedback control is not under way in step S91 (step S91; No), the ECU 20 determines whether the fuel increase for power is under way or not (step S96). When the fuel increase for power is not under way, the ECU 20 sets the increase flag XRCT=0 and performs increase of the fuel (step S97). On the other hand, in the case after the fuel increase for power (step S96; Yes), the ECU 20 does not perform fuel increase (namely, maintain the increase flag XCRT=1), and terminates the processing.

As described above, according to the fifth embodiment, after feedback control becomes open by the fuel increase for power, the processing returns to the feedback control without performing fuel increase, unlike the case in which the feedback control becomes open by F/C. Thereby, useless fuel consumption can be suppressed, and it is made possible to shift to the feedback control at the target air/fuel ratio quickly.

In the example of FIG. 14, whether the feedback control corresponds to the fuel increase amount or not is determined based on the number of skips of the feedback correction amount as in the second example of the third embodiment, but instead of this, the same determination can be performed by, determining whether the feedback correction amount FAF reaches the correction amount corresponding to the fuel increase amount FRICH1 or not, as in the first embodiment and the like.

Sixth Embodiment

Next, the sixth embodiment will be explained. The sixth embodiment relates to a method of adjusting the feedback correction amount of the feedback control at the time of stopping fuel increase.

FIRST EXAMPLE

As described in the first to the fifth embodiments, in the present invention, fuel increase is stopped at the point of time when the feedback correction amount reaches the correction amount corresponding to the fuel increase amount after fuel increase. However, if fuel increase is stopped at the point of time when the feedback correction amount reaches the fuel increase amount, the feedback correction amount is abruptly varied in order to follow the fuel increase amount and the air/fuel ratio abruptly changes to be unstable, thus causing possibility of vibration and the like occurring to the vehicle. For example, it is assumed that fuel increase by 10% is performed after the engine starts. The feedback control changes the feedback correction amount to −10% to correspond to the fuel increase. When the feedback correction amount reaches −10%, the feedback correction amount FAF reaches the correction amount (−10%) corresponding to the fuel increase amount, and as explained in the first embodiment and the like, the fuel increase is stopped at this point of time. However, since fuel injection of the increase amount (10%) is cut instantly at the time of stopping the fuel increase, vibration and the like can be caused to the vehicle. In addition, the feedback control tries to follow this and abruptly increases the feedback correction amount, and therefore the air/fuel ratio is varied comparatively sharply, which makes the air/fuel ratio control unstable. This can also cause vibration and the like to the vehicle.

Thus, in the sixth embodiment, the feedback correction amount is corrected by the amount corresponding to the increase amount at the same time when the fuel increase is stopped. In the above-described example, at the same time when the fuel increase of 10% is stopped, the correction amount corresponding to the increase amount, namely, 10% is added to the feedback correction amount FAF which is −10% so far, thus changing the feedback correction amount FAF to 0%. Thereby, a large change in the correction amount by the feedback control can be prevented at the time of stopping the fuel increase, and vibration and the like can be prevented from occurring to the vehicle.

Figure 17:
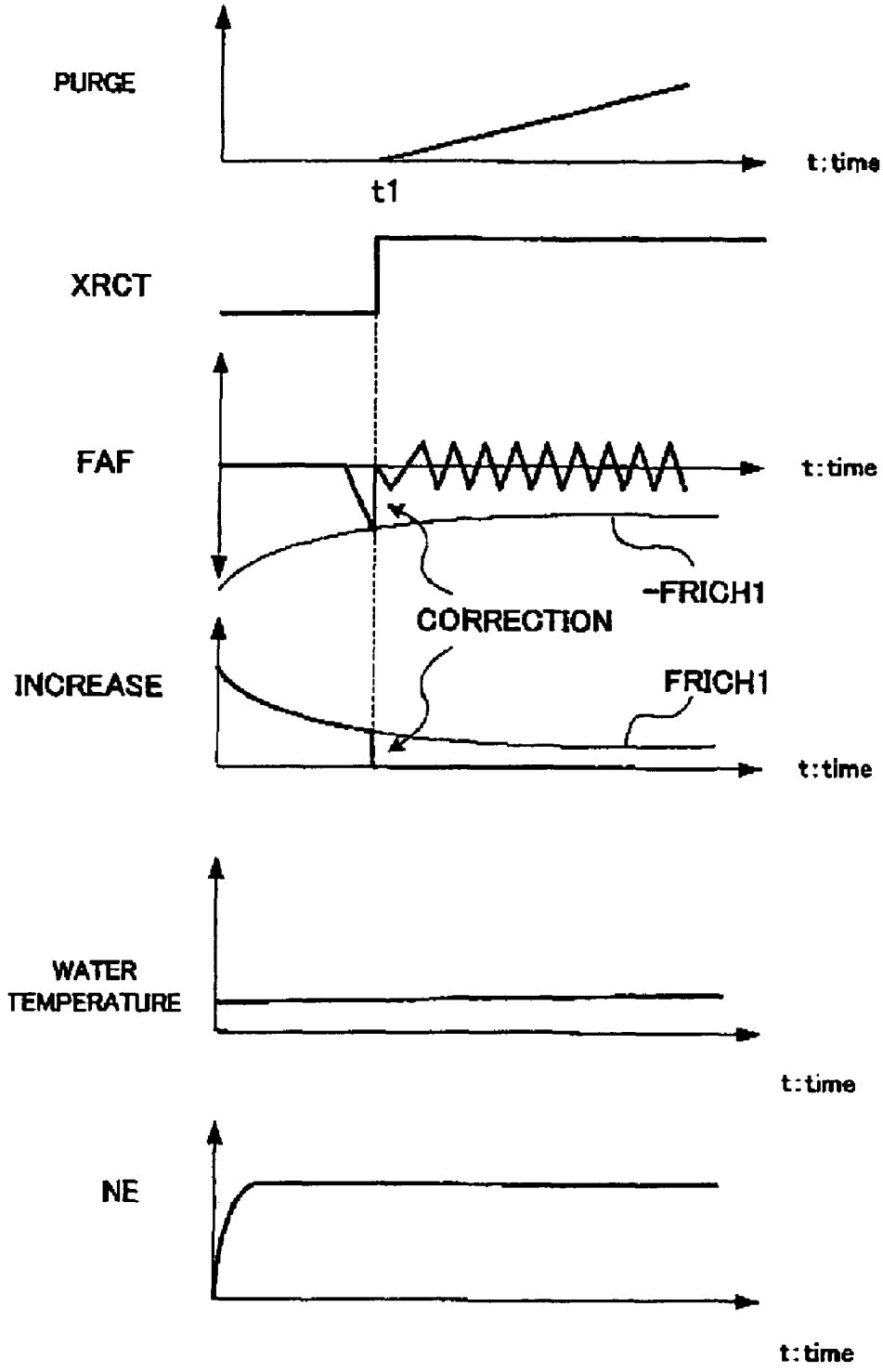
FIG. 17 is a timing chart of the increase stop control of the fuel in the first example of the sixth embodiment.

FIG. 17 shows a timing chart of an increase stop control example according to a first example of the sixth embodiment. Before the time t1, fuel increase is performed. At the time t1, the feedback correction amount FAF reaches the correction amount (−FRICH1+α) corresponding to the fuel increase amount FRICH1 and the increase flag XRCT=1 is set, and the fuel increase is stopped. At the same time as this, the feedback correction amount FAF is changed to zero at the time t1. Thereafter, the feedback control is executed and the feedback correction amount FAF is varied within the values near zero.

Figure 16:
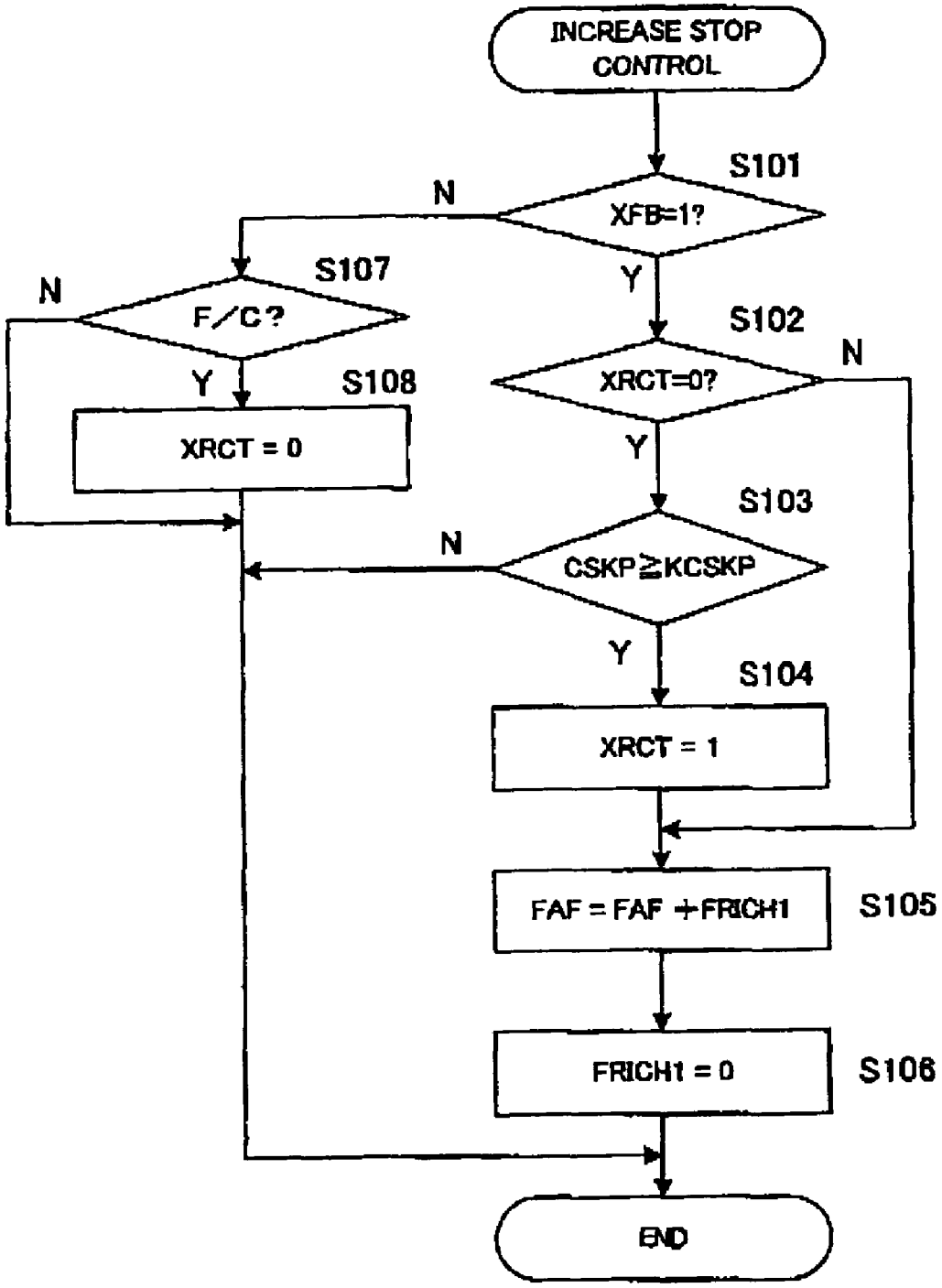
FIG. 16 is a flow chart of the increase stop control of the fuel in a first example of a sixth embodiment.

Next, the increase stop control of the first example of the sixth embodiment will be explained. A flow chart of the increase stop control of the first example is shown in FIG. 16. First, the ECU 20 determines whether the feedback control flag XFB=1 or not, namely, whether the feedback control is under way or not (step S101). When the feedback control is under way (step S101: Yes), the ECU 20 determines whether the increase flag XRCT=0 or not, namely, whether the fuel is under increase or not (step S102). When the fuel is under increase (step S102; Yes), the ECU 20 determines whether the number CSKP of skips of the feedback correction amount becomes equal to or larger than the predetermined number KSCKP of skips or not (step S103).

When the number CSKP of skips of the feedback correction amount becomes equal to or larger than the predetermined number KSCKP of skips (step S103; Yes), the ECU 20 determines that the present feedback correction amount FAF reaches the correction amount corresponding to the increase amount FRICH1 of the fuel. Therefore, the ECU 20 sets the increase flag XRCT=1 (step S104), adds the fuel increase amount FRICH1 to the feedback correction amount FAF, and thereby sets a new feedback correction amount FAF (step S105). In the above-mentioned example, $$FAF=FAF+FRICH1=-10\%+10\%=0$$

and the FAF is adjusted to 0%. Further, the ECU 20 sets the fuel increase amount FRICH1=0 (step S105), and stops increase of the fuel. In this manner, the ECU 20 stops increase of the fuel quickly when the feedback correction amount by the air/fuel ratio feedback control reaches the correction amount corresponding to the fuel increase amount.

On the other hand, when it is determined that feedback control is not underway in step S101 (step S101; No), the ECU 20 determines whether F/C is under way or not (step S107). When F/C is under way, the ECU 20 sets the increase flag XRCT=0 (step S108).

As described above, according to the first example of the sixth embodiment, when the feedback correction amount reaches the correction amount corresponding to the fuel increase amount and the fuel increase is stopped, the feedback correction amount FAF is adjusted by the amount corresponding to the fuel increase amount. Therefore, large variation of the air/fuel ratio after the stop of the fuel increase is prevented, and vibration and the like can be prevented from occurring to the vehicle when the fuel increase is stopped.

In the example of FIG. 16, it is determined whether the feedback control corresponds to the fuel increase amount or not based on the number of skips of the feedback correction amount as in the second example of the third embodiment, but instead of this, the same determination can be performed by determining whether the feedback correction amount FAF reaches the correction amount corresponding to the fuel increase amount FRICH1 or not, as in the first embodiment and the like. In the example of FIG. 16, the sixth embodiment is applied to the example of the fifth embodiment including the control after F/C, but it is possible to apply the sixth embodiment to, for example, the first to the fourth embodiments which do not include the control after F/C.

SECOND EXAMPLE

Next, a second example of the sixth embodiment will be explained. In the first example, at the time of stopping the fuel increase, the fuel increase is stopped at a dash, and at the same time, the feedback correction amount is adjusted correspondingly. On the other hand, in the second example, the fuel increase amount is gradually decreased in a range of an integration constant (time constant) of the feedback control.

Figure 19:
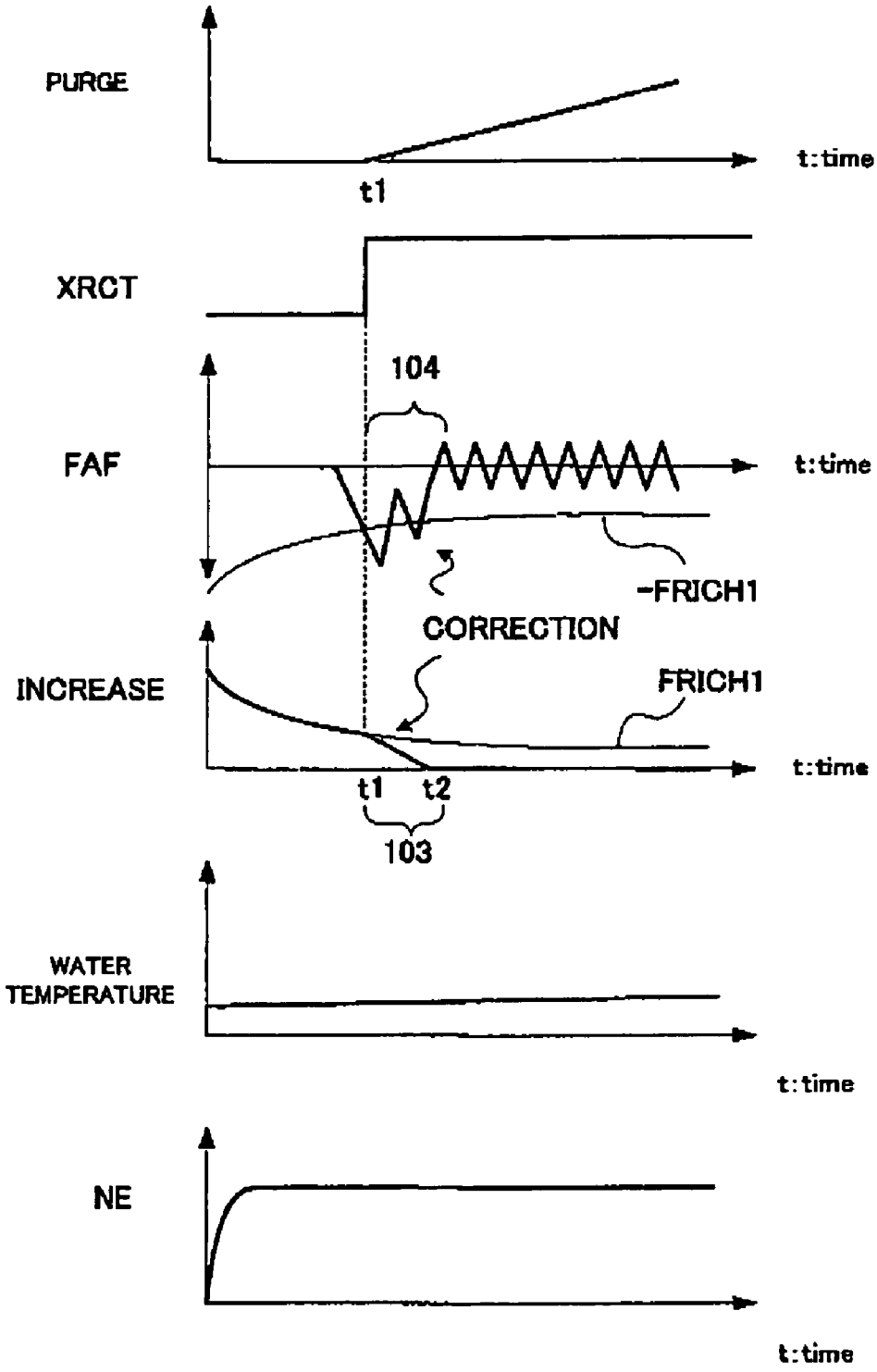
FIG. 19 is a timing chart of the increase stop control of the fuel in the second example of the sixth embodiment.

A timing chart of an increase stop control example according to the second example is shown in FIG. 19. It is assumed that the feedback control amount FAF reaches the correction amount corresponding to the fuel increase amount FRICH1 at the time t1 after execution of increase control. When the ECU 20 gradually decreases the fuel increase amount FRICH1 as shown in a region 103 after the time t1, the feedback control follows this, and the feedback correction amount FAF gradually increases as shown in a region 104. Subsequently, in the vicinity of the time t2 when the fuel increase amount substantially becomes zero, the feedback correction amount FAF also reaches the vicinity of zero, and thereafter the feedback correction amount FAF is kept around zero by the feedback control. By gradually decreasing the fuel increase amount FRICH1 in this manner instead of stopping increase of the fuel at a dash, the feedback correction amount follows the change and gradually varies, and ultimately reaches the vicinity of zero. As a result, large variation of the air/fuel ratio and vibration or the like which possibly occurs to the vehicle when the fuel increase is stopped can be prevented. In order to enable the feedback control to follow the change of the fuel increase amount FRICH1, it is necessary to gradually change the fuel increase amount FRICH1 under the integration constant of the feedback control.

Figure 18:
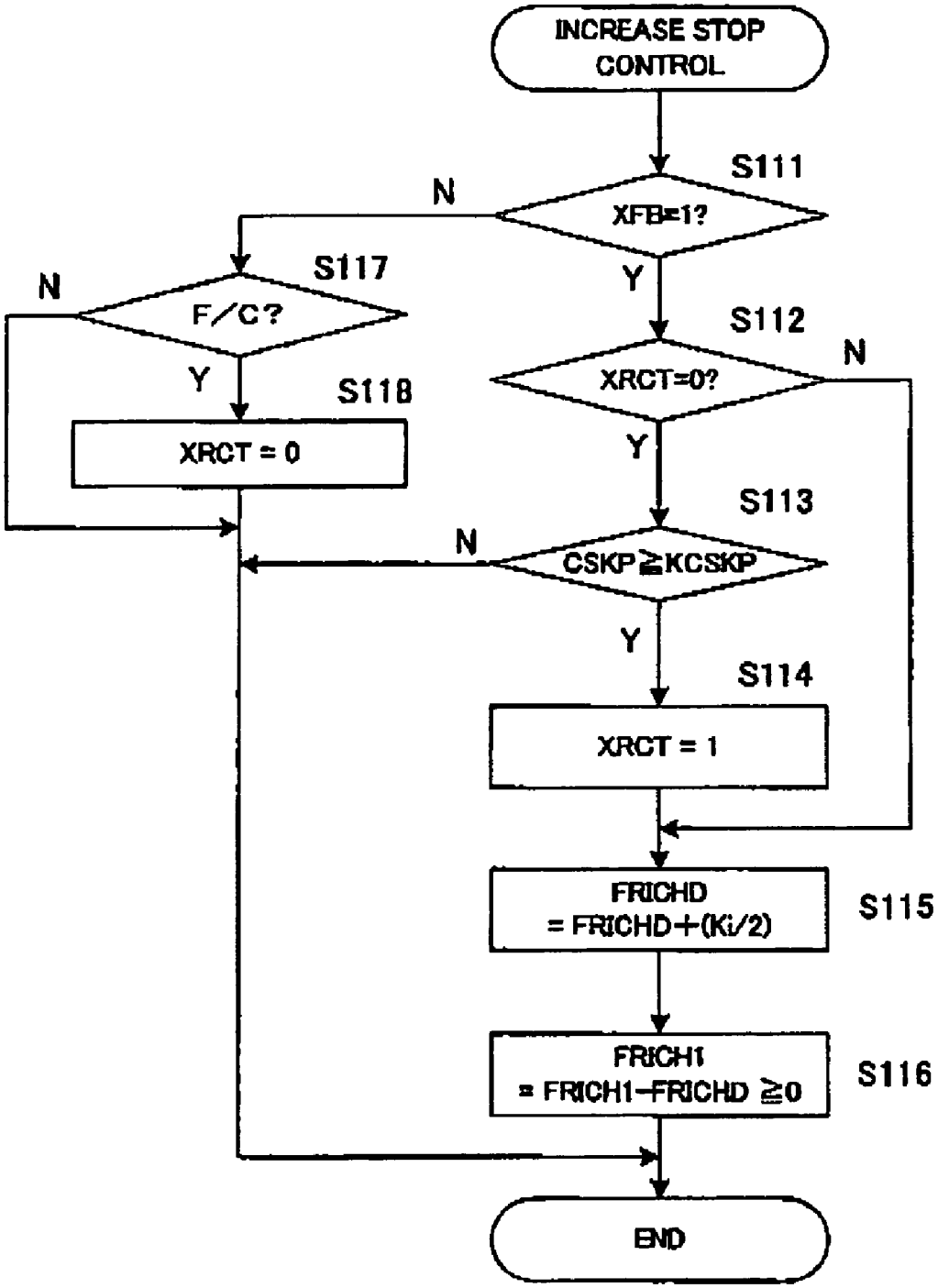
FIG. 18 is a flow chart of the increase stop control of the fuel in a second example of the sixth embodiment.

Next, the increase stop control of the second example of the sixth embodiment will be explained. A flow chart of the increase stop control of the second example is shown in FIG. 18. First, the ECU 20 determines whether the feedback control flag XFB=1 or not, namely, whether the feedback control is under way or not (step S111). When the feedback control is under way (step S111; Yes), the ECU 20 determines whether the increase flag XRCT=0 or not, namely, whether the fuel is under increase or not (step S112). When it is under increase (step S112; Yes), the ECU 20 determines whether the number CSKP of skips of the feedback correction amount becomes equal to or larger than the predetermined number KSCKP of skips or not (step S113).

When the number of skips CSKP becomes equal to or larger than the predetermined number of skips (step S113; Yes), the ECU 20 determines that the present feedback correction amount FAF reaches the correction amount corresponding to the increase amount FRICH1 of the fuel. Therefore, the ECU 20 sets the increase flag XRCT=1 (step S114). Next, the ECU 20 determines a decrease amount FRICHD of the fuel increase amount (step S115). Here, the decrease amount FRICHD is the amount of fuel decreased from the fuel increase amount FRICH1 every time this routine is executed, and as the initial value, FRICHD=0 is set. The decrease amount FRICHD is obtained by the following formula.

$$FRICHD=FRICHD+(Ki/2)$$

Here, "Ki" is the amount corresponding to the integration constant of the feedback control. Namely, the decrease amount FRICHD increases by ½ of the integration constant of the feedback control. The ECU 20 subtracts the decrease amount FRICHD from the fuel increase amount FRICH1 up to this time and sets a new fuel increase amount FRICH1 (step S116).

Thus, after the feedback correction amount FAF reaches the correction amount corresponding to the fuel increase amount (namely, after step S113; Yes), the fuel increase amount FRICH1 gradually decreases by ½ of the integration constant of the feedback control every time the routine shown in FIG. 18 is executed once. The feedback correction amount FAF follows this, and therefore the feedback correction amount FAF also becomes substantially zero at the point of time when the fuel increase amount FRICH1=0 is satisfied.

On the other hand, when it is determined that the feedback control is not under way in step S111 (step S111; No), the ECU 20 determines whether F/C is under way or not (step S117). When F/C is under way, the ECU 20 sets the increase flag XRCT=0 (step S118).

As described above, according to the second example of the sixth embodiment, when the feedback correction amount reaches the correction amount corresponding to the fuel increase amount, and the fuel increase is stopped, the fuel increase amount is gradually decreased within the integration constant (time constant) of the feedback control. Since the feedback correction amount FAF follows this and gradually increase to close to zero, the feedback correction amount FAF also reaches the vicinity of zero when the fuel increase amount FRICH1 becomes zero, and the feedback control is continued. Therefore, large variation of the air/fuel ratio after stop of the fuel increase is prevented, and the vibration or the like can be prevented from occurring to the vehicle when the fuel increase is stopped.

In the example of FIG. 18, it is determined whether the feedback control corresponds to the fuel increase amount or not based on the number of skips of the feedback correction amount as in the second example of the third embodiment, but instead of this, the same determination can be performed by determining whether the feedback correction amount FAF reaches the correction amount corresponding to the fuel increase amount FRICH1 or not, as in the first embodiment and the like. In the example of FIG. 18, the sixth embodiment is applied to the fifth embodiment including the control after F/C, but it is possible to apply the sixth embodiment to, for example, the first to the fourth embodiments which do not include the control after F/C.

Seventh Embodiment

Next, a seventh embodiment of the present invention will be explained. The seventh embodiment relates to fuel increase and increase stop control when the gear is operated from a neutral (N) to a drive range (D-range) in a vehicle loaded with an automatic transmission. When the gear is shifted to the D-range from the neutral position by the driver, the fuel increase is performed (hereinafter, called "D-range fuel increase"). In this case, the fuel increase is stopped when the feedback correction amount reaches the correction amount corresponding to the increase amount.

Figure 21:
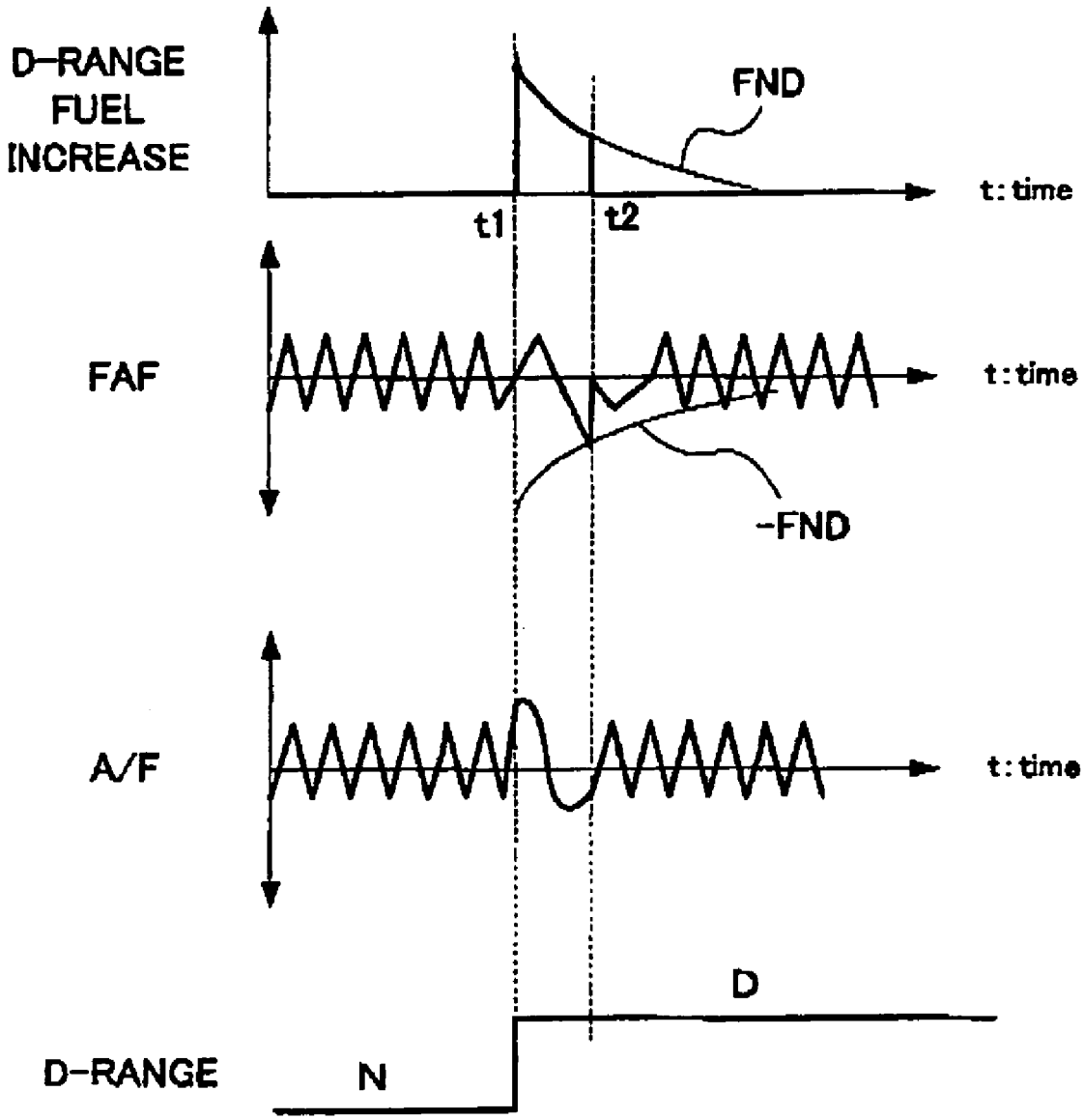
FIG. 21 is a timing chart of the increase stop control of the fuel in the seventh embodiment.

A control example in this case is shown in a timing chart of FIG. 21. When the change to the D-range from the neutral position is performed at the time t1, the D-range fuel increase amount FND occurs, and the feedback correction amount FAF is varied corresponding to this. The air/fuel ratio A/F also changes. When the feedback correction amount FAF reaches the correction amount (namely −FND) corresponding to the D-range fuel increase amount FND at the time t2, the ECU 20 sets the D-range fuel increase amount FND to zero, and stops the D-range fuel increase.

Next, a flow chart of the increase stop control according to the seventh embodiment will be explained with reference to FIG. 20. First, the ECU 20 detects whether the gear is in the D-range or not by the detection signal or the like from a switch of a shift lever (step S121). When the gear is in the D-range (step S121; Yes), the ECU 20 determines whether the D-range flag XD=1 or not. The D-range flag XD=0 is set when the routine is executed for the first time after the gear is shifted to the D-range. Therefore, the processing goes to step S130, and the D-range flag XD=1 is set. Then, the ECU 20 determines the D-range fuel increase amount FND based on the cooling water temperature or the like at this time (step S131).

Since the D-range flag DX=1 at the time of the execution of the routine of the second time and thereafter, the processing goes from step S122 to S123, wherein the D-range fuel increase amount FND is decreased by a predetermined amount KD, and the processing goes to step S124. In this manner, the D-range fuel increase amount FND is decreased by the predetermined amount KD every time the routine is executed (see the graph of the D-range fuel increase in FIG. 21).

Next, the ECU 20 determines whether the feedback control flag XFB=1 or not, namely, whether the feedback control is under way or not (step S124). When the feedback control is under way, the ECU 20 determines whether the increase cut flag XRCTD=0 or not (step S125). The increase cut flag XRCTD indicates continuation of the fuel increase when the increase cut flag XRCTD is "0" and indicates stop of the fuel increase when it is "1". When the increase cut flag XRCTD=0 (step S125; Yes), the ECU 20 determines whether the number CSKP of skips of the feedback correction amount in the feedback control (number of positive and negative inversions) becomes equal to or larger than the predetermined number KCSKP of skips or larger or not (step S126). When the number CSKP of skips becomes equal to or larger than the predetermined number of skips, the ECU 20 determines that the feedback correction amount FAF reaches the correction amount corresponding to the D-range fuel increase amount as in the fifth embodiment, sets the increase cut flag XRCTD=1, and stops the D-range fuel increase (step S127). At the same time, the ECU 20 sets the feedback correction amount FAF to substantially zero by adding the D-range fuel increase amount FND to the feedback correction amount FAF (step S128). This is for preventing variation in the air/fuel ratio and vibration of the vehicle at the time of stop of the D-range fuel increase, as in the first example of the sixth embodiment. Further, the ECU 20 sets the D-range fuel increase amount FND=0, and terminates the processing (step S129).

On the other hand, when it is determined that the gear is not in the D-range in step S121, the ECU sets the D-range, flag XD=0 (step S132), then sets the increase cut flag XRCTD=0 (step S133) and terminates the processing.

When the gear is operated into the D-range and the routine is executed first by the above processing, the processing goes to steps S121 to S122 to S130, the D-range flag XD=1 is set, and further, the D-range fuel increase amount FND is determined. On the other hand, at the time of the execution of the second time and thereafter, the D-range fuel increase amount FND gradually decreases by the steps S122 and S123. When the feedback correction value FAF reaches the correction amount corresponding to the D-range fuel increase amount (step S126; Yes), the ECU 20 stops the D-range fuel increase (steps S127 to S129).

As described above, according to the seventh embodiment, at the time of fuel increase other than the fuel increase at the time of start of the engine, for example at the time of D-range fuel increase, the air/fuel ratio can be also prevented from being brought into the lean state at the early stage after the fuel increase is carried out. When the correction amount by the feedback control reaches the correction amount corresponding to the D-range fuel increase amount thereafter, the fuel increase is stopped quickly, and thereby useless fuel consumption can be prevented.

Figure 20:
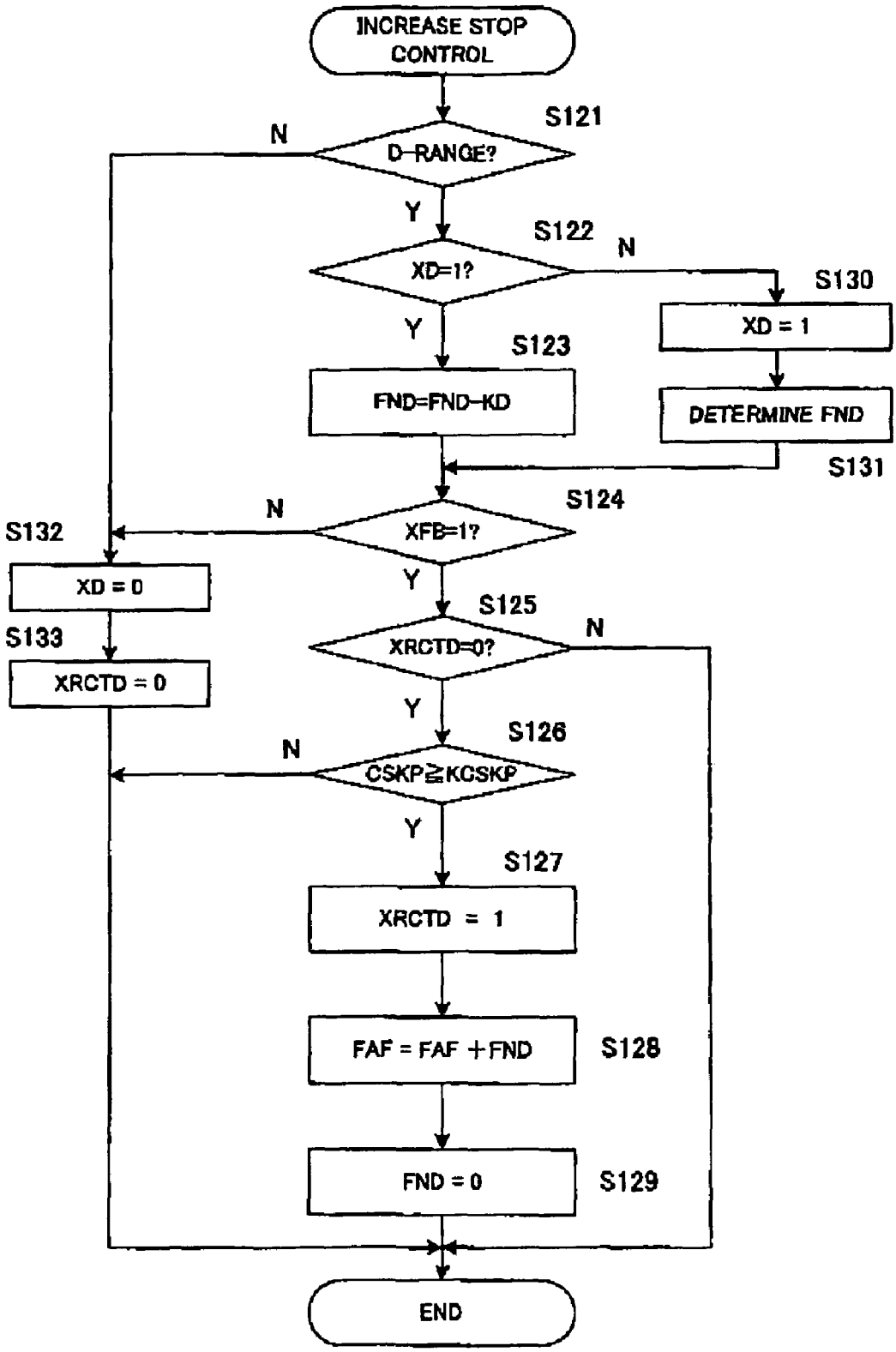
FIG. 20 is a flow chart of the increase stop control of the fuel in a seventh embodiment.

In the example of FIG. 20, it is determined whether the feedback control corresponds to the fuel increase amount or not based on the number of skips of the feedback correction amount as in the second example of the third embodiment, but instead of this, the same determination can be performed by determining whether the feedback correction amount FAF reaches the correction amount corresponding to the fuel increase amount FRICH1 or not, as in the first embodiment and the like.

MODIFICATION EXAMPLE

In each of the above-described embodiments, it is explained that increase of the fuel injection amount is stopped, but instead of completely stopping the fuel increase, the fuel increase may be decreased to a small increase amount which does not have adverse effect on the other controls such as vapor concentration learning operation in the purge control, for example.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2004-7184 filed on Jan. 14, 2004 including the specification. claims, drawings and summary is incorporated herein by reference in its entirety.

What is claimed is:

1. A control apparatus for an internal combustion engine, comprising:

an increasing unit which increases a fuel injection amount under a predetermined condition;

an air/fuel ratio feedback control unit which controls the fuel injection amount based on an output of an oxygen concentration sensor;

a control unit which decreases an increase amount of the fuel injection amount by the increasing unit when the air/fuel ratio feedback unit corrects the increase amount of the fuel injection amount by the increasing unit, if the increasing unit increases the fuel injection amount during an air/fuel ratio feedback control by the air/fuel ratio feedback control unit; and a purge control unit which inhibits a purge of a canister while the increasing unit increases the fuel injection amount during an air/fuel ratio feedback control, and executes the purge of the canister immediately after the control unit decreases the increase amount of the fuel injection amount.

2. The control apparatus for an internal combustion engine according to claim 1, wherein the control unit performs a determination of whether the increase amount of the fuel injection amount by the increasing unit is corrected or not after a predetermined time elapses from a start of feedback control by the air/fuel ratio feedback control unit.

3. The control apparatus for an internal combustion engine according to claim 1, wherein the control unit does not perform a determination of whether the increase amount of the fuel injection amount by the increasing unit is corrected or not during deceleration of the internal combustion engine.

4. The control apparatus for an internal combustion engine according to claim 1, wherein the control unit performs a determination of whether the increase amount of the fuel injection amount by the increasing unit is corrected or not when load variation of the internal combustion engine is equal to or smaller than a predetermined amount.

5. The control apparatus for an internal combustion engine according to claim 1, wherein the control unit determines that the increase amount of the fuel injection amount is corrected when a feedback correction amount by the air/fuel feedback control unit becomes a correction amount corresponding to an increase amount of the fuel injection amount.

6. The control apparatus for an internal combustion engine according to claim 5, wherein the control unit determines that the increase amount of the fuel injection amount by the increasing unit is corrected when an average value of the feedback correction amounts becomes the correction amount corresponding to the increase amount of the fuel injection amount.

7. The control apparatus for an internal combustion engine according to claim 1, wherein the control unit determines that the increase amount of the fuel injection amount by the increasing unit is corrected or not when a number of skips of a feedback correction amount by the air/fuel ratio feedback control unit becomes equal to or larger than a predetermined number.

8. The control apparatus for an internal combustion engine according to claim 1, further comprising a fuel cut unit which executes fuel cut when a predetermined fuel cut condition is satisfied, wherein the increasing unit increases the fuel injection amount after execution of the fuel cut; and wherein, after the fuel injection amount is increased by the increasing unit, the control unit decreases the increase amount of the fuel injection amount by the increasing unit.

9. The control apparatus for an internal combustion engine according to claim 1, wherein the control unit decreases the increase amount of the fuel injection amount by the increasing unit, and at the same time, increases a feedback correction amount by the air/fuel ratio feedback control unit by the increase amount of the fuel injection amount.

10. The control apparatus for an internal combustion engine according to claim 1, wherein the control unit decreases the increase amount of the fuel injection amount by the increasing unit at a predetermined rate, and increases a feedback correction amount by the air/fuel ratio feedback control unit by the increase amount of the fuel injection amount at a rate corresponding to the predetermined rate.

11. The control apparatus for an internal combustion engine according to claim 10, wherein the predetermined rate is smaller than an integration constant of the air/fuel ratio feedback control unit.

* * * * *